US007560204B2

(12) United States Patent
Toda et al.

(10) Patent No.: US 7,560,204 B2
(45) Date of Patent: Jul. 14, 2009

(54) LATENT ELECTROSTATIC IMAGE BEARING MEMBER, AND THE METHOD FOR PRODUCING THE SAME, IMAGE FORMING METHOD, IMAGE FORMING APPARATUS, AND PROCESS CARTRIDGE

(75) Inventors: Naohiro Toda, Yokohama (JP); Yasuyuki Yamashita, Zama (JP); Takeshi Orito, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 262 days.

(21) Appl. No.: 11/519,098

(22) Filed: Sep. 12, 2006

(65) Prior Publication Data

US 2007/0059617 A1 Mar. 15, 2007

(30) Foreign Application Priority Data

Sep. 12, 2005 (JP) ..... 2005-263933

(51) Int. Cl.
*G03G 5/047* (2006.01)

(52) U.S. Cl. ..... 430/58.05; 430/59.5; 430/133; 399/159

(58) Field of Classification Search ..... 430/58.05, 430/64, 133, 59.5; 399/159
See application file for complete search history.

(56) References Cited

U.S. PATENT DOCUMENTS

| | | | | |
|---|---|---|---|---|
| 5,173,384 | A * | 12/1992 | Otsuka | 430/58.15 |
| 2004/0053149 | A1* | 3/2004 | Toda et al. | 430/58.7 |
| 2004/0120730 | A1* | 6/2004 | Niimi et al. | 399/159 |
| 2005/0026058 | A1 | 2/2005 | Kami et al. | |
| 2005/0053853 | A1 | 3/2005 | Sugino et al. | |
| 2005/0058918 | A1 | 3/2005 | Kurimoto et al. | |
| 2005/0118518 | A1 | 6/2005 | Ikegami et al. | |

FOREIGN PATENT DOCUMENTS

| | | |
|---|---|---|
| EP | 1 521 126 A1 | 4/2005 |
| JP | 64-17066 | 1/1989 |
| JP | 1-259364 | 10/1989 |
| JP | 4-101152 | 4/1992 |
| JP | 5-34956 | 2/1993 |
| JP | 6-266126 | 9/1994 |

(Continued)

OTHER PUBLICATIONS

U.S. Appl. No. 12/030,866, filed Feb. 14, 2008, Toda et al.

*Primary Examiner*—John L Goodrow
(74) *Attorney, Agent, or Firm*—Oblon, Spivak, McClelland, Maier & Neustadt, P.C.

(57) ABSTRACT

The present invention provides a latent electrostatic image bearing member which includes a support, a charge generating layer, and a charge transporting layer, the charge generating layer and the charge transporting layer being arranged in this order on or above the support, wherein the charge transporting layer comprises at least a charge transporting material and a binder resin and has a thickness of 30 μm to 50 μm; and the distribution representing the relation between the absorbance ratio of the charge transporting material and the binder resin measured by infrared spectroscopy and the distance from the surface of the charge transporting layer toward the thickness direction thereof represents a generally linear shape without having inflection points within 20 μm from the surface of the charge transporting layer toward the thickness thereof.

21 Claims, 11 Drawing Sheets

FOREIGN PATENT DOCUMENTS

| | | |
|---|---|---|
| JP | 10-142815 | 5/1998 |
| JP | 3125581 | 11/2000 |
| JP | 2001-222119 | 8/2001 |
| JP | 2001-318474 | 11/2001 |
| JP | 3277656 | 2/2002 |
| JP | 2003-66634 | 3/2003 |
| JP | 2004-326070 | 11/2004 |
| JP | 2005-189822 | 7/2005 |

* cited by examiner

LATENT ELECTROSTATIC IMAGE BEARING MEMBER, AND THE METHOD FOR PRODUCING THE SAME, IMAGE FORMING METHOD, IMAGE FORMING APPARATUS, AND PROCESS CARTRIDGE

FIELD OF THE INVENTION

The present invention relates to a latent electrostatic image bearing member (hereinafter, may be referred to as "electrophotographic photoconductor", "photoconductor", or "image bearing member") suitably used for laser beam printers, facsimiles, digital copiers, and the like, and a method for producing the latent electrostatic image bearing member. The present invention also relates to an image forming method, an image forming apparatus, and a process cartridge using the latent electrostatic image bearing member.

DESCRIPTION OF THE RELATED ART

Conventionally, electrophotographic photoconductors using organic photoconductive materials which are superior in sensitivity, thermal stability, and nontoxity, etc. have been increasingly developed to inorganic materials such as Se, CdS, and ZnO as photoconductive materials for electrophotographic photoconductors, and such electrophotographic photoconductors are installed to a number of copiers and printers.

For a photosensitive layer used in such an electrophotographic photoconductor using an inorganic photoconductive material, a function-separated photosensitive layer in which a charge transporting layer is disposed on a charge generating layer in laminate structure excels in sensitivity and durability and is widely used.

In recent years, with increasing in speeding-up and high-durability performance of electrophotographic copiers, photoconductors have become strongly required to have the reliability that high-quality of images can be maintained in repetitive use over a long period of time. In particular, an ultrahigh-speed copier yields a large volume of copied sheets and is often stopped at the time of exchange of photoconductors, which has become a cause of significantly reducing the productivity, and thus improvements in durability of photoconductors are desired.

In the field of color copiers, tandem color copiers in which four image forming elements for each four colors of cyan, magenta, yellow, and black are arrayed in parallel, are widely employed. Such a tandem color copier usually uses a photoconductor having a smaller diameter than that of a conventional photoconductor to avoid growing in size of the body of the copier, and further high-durability performance of photoconductors is demanded to respond to speeding-up performance of image forming apparatuses in recent years.

As one of causes of abnormal images derived from photoconductors in image forming systems used today in which negative-positive developing method is primarily used, there are occurrences of background smear. The occurrences of background smear are typically caused from contamination of a support, defects in a support, dielectric breakdown of a photosensitive layer, injection of carrier. (charge) from a support, increases in dark attenuation of a photoconductor, generation of a heated carrier in a photosensitive layer, etc. Particularly, in a multilayered photosensitive layer, a reduced thickness of a charge transporting layer and increased electric field intensity significantly degrades the properties the photosensitive layer.

In view of these shortcomings, Japanese Patent (JP-B) No. 3125581 and Japanese Patent Application Laid-Open (JP-A) No. 06-266126 respectively propose a technique to improve the durability of a photoconductor by increasing the thickness of a charge transporting layer.

In recent years, the movement for reducing environmental burdens is actively addressed, for example, Japanese Patent Application Laid Open (JP-A) Nos. 2001-222119, 2003-66634, and 2004-326070 respectively propose to reduce environmental burdens by replacing a halogen solvent which excels in solubility and coating property of resins with a non-halogen solvent.

A charge transporting layer formed using such a non-halogen solvent needs to form a relatively thick charge transporting layer so as to have a thickness of 30 μm or more. As the result, the electric field intensity of the charge transporting layer is reduced, resins and wax in a toner easily adhere on the photoconductor when the photoconductor is repeatedly used to result in occurrences in abnormal images, although the effect of preventing occurrences of background smear can be obtained even when the photoconductor is repeatedly used.

Thus, a latent electrostatic image bearing member which has improved in durability and allows stable formation of images without substantially causing abnormal images such as background smear and toner filming even when repeatedly used over a long period of time has not yet been provided, and a method for producing a latent electrostatic image bearing member by which environmental burdens can be reduced, an image forming method, an image forming apparatus and a process cartridge using the latent electrostatic image bearing member have not yet been provided.

SUMMARY OF THE INVENTION

The object of the present invention is to provide a latent electrostatic image bearing member which has improved in durability and allow stable image formation without substantially causing abnormal images such as background smear and toner filming even when repeatedly used over a long period of time, and a method for producing a latent electrostatic image bearing member by which environmental burdens can be reduced, an image forming method, an image forming apparatus and a process cartridge using the latent electrostatic image bearing member.

The latent electrostatic image bearing member according to a first embodiment of the present invention has a support, and has at least a charge generating layer and a charge transporting layer arranged in this order on or above the support, wherein the charge transporting layer contains at least a charge transporting material and a binder resin and has a thickness of 30 μm to 50 μm; and the distribution representing the relation between the absorbance ratio of the charge transporting material and the binder resin measured by infrared spectroscopy and the distance from the surface of the charge transporting layer toward the thickness of the charge transporting layer represents a generally linear shape without having inflection points within 20 μm from the surface of the charge transporting layer toward the thickness thereof.

The latent electrostatic image bearing member according to a second embodiment of the present invention has a support, and has at least a charge generating layer and a charge transporting layer arranged in this order on or above the support, wherein the charge transporting layer contains at least a charge transporting material and a binder resin and has a thickness of 30 μm to 50 μm; and an absorbance ratio A between the charge transporting material and the binder resin in the surface of the charge transporting layer measured by infrared spectroscopy and an absorbance ratio B between the charge transporting material and the binder resin at 5 μm inside from the surface of the charge transporting layer measured by infrared spectroscopy satisfy the relation B/A=1.0 to 1.15.

In the latent electrostatic image bearing members according to the first and second embodiments, it is possible to have improved durability and stably form an image without substantially causing abnormal images such as background smear and toner filming even when used for a long period of time.

The method for producing a latent electrostatic image bearing member of the present invention includes at least forming a charge transporting layer by applying a coating solution for charge transporting layer containing at least a charge transporting material, a binder resin, and a non-halogen solvent over a surface of the charge generating layer and drying the surface thereof, and subjecting the formed charge transporting layer to at least one of surface treatment selected from heat treatment, UV irradiation treatment, electron beam irradiation treatment, and corona discharge treatment.

In the method for producing a latent electrostatic image bearing member of the present invention, a charge transporting layer can be formed using a non-halogen solvent, and thus latent electrostatic image bearing members can be efficiently produced while reducing environmental burdens.

The image forming apparatus of the present invention is provided with at least a latent electrostatic image bearing member, a latent electrostatic image forming unit configured to form a latent electrostatic image on the surface of the latent electrostatic image bearing member, a developing unit configured to develop the latent electrostatic image using a toner to form a visible image, a transferring unit configured to transfer the visible image onto a recording medium, and a cleaning unit configured to remove a residual toner remaining on the surface of the latent electrostatic image bearing member, wherein the latent electrostatic image bearing member is the latent electrostatic image bearing member of the present invention. The image forming apparatus of the present invention can form high-quality images because the latent electrostatic image bearing member of the present invention which is highly durable over a long period of time is used therein.

The image forming method of the present invention includes at least forming a latent electrostatic image on the surface of a latent electrostatic image bearing member, developing the latent electrostatic image using a toner to form a visible image, transferring the visible image onto a recording medium, fixing the transferred image on the recording medium, and cleaning a residual toner remaining on the latent electrostatic image bearing member, wherein the latent electrostatic image bearing member is the latent electrostatic image bearing member of the present invention. When the image forming method of the present invention is used, high-quality images can be formed because the latent electrostatic image bearing member of the present invention which is highly durable over a long period of time is used.

The process cartridge of the present invention is provided with the latent electrostatic image bearing member of the present invention and is further provided with at least one selected from a charging unit, a developing unit, a transferring unit, a cleaning unit, and a charge-eliminating unit, and can be detachably mounted on a body of an image forming apparatus. Since the latent electrostatic image bearing member of the present invention is used in the process cartridge, it is possible to obtain images having high-flaw resistance and high-abrasion resistance without reducing the surface resistivity even under high-humidity environment, and it is also possible to obtain highly durable and high-quality images over a long period of time even under high-temperature environment, which can be typically observed in high-speed processing. Even when blade cleaning is performed, an extremely small amount of abrasion of the latent electrostatic image bearing member can be prevented, and the cleaning property is also excellently ensured.

DESCRIPTION OF THE PREFERRED EMBODIMENTS (Latent Electrostatic Image Bearing Member)

The latent electrostatic image bearing member of the present invention has a support and has at least a charge generating layer and a charge transporting layer arranged in this order on or above the support and may further have a charge blocking layer, a moiré preventing layer, and other layers in accordance with the necessity.

Figure 1:
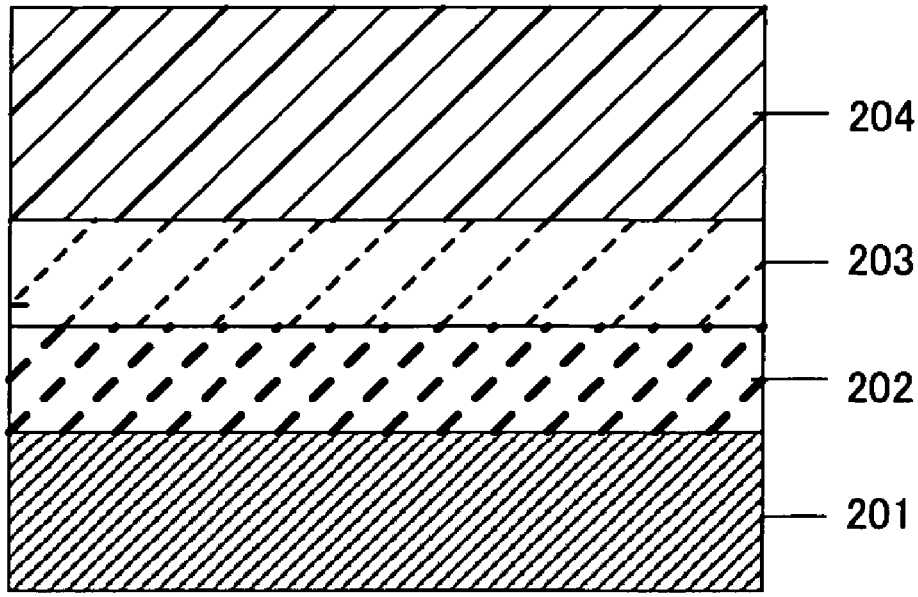
FIG. 1 is a cross-sectional view schematically showing one example of the latent electrostatic image bearing member of the present invention.

FIG. 1 is a cross-sectional view schematically showing one example of embodiments of the latent electrostatic image bearing member of the present invention. The latent electrostatic image bearing member takes a structure in which a moiré preventing layer 202, a charge generating layer 203, and a charge transporting layer 204 are formed in this order on or above a support 201. The latent electrostatic image bearing member may take a structure in which the moiré preventing layer 202 is not formed.

Figure 2:
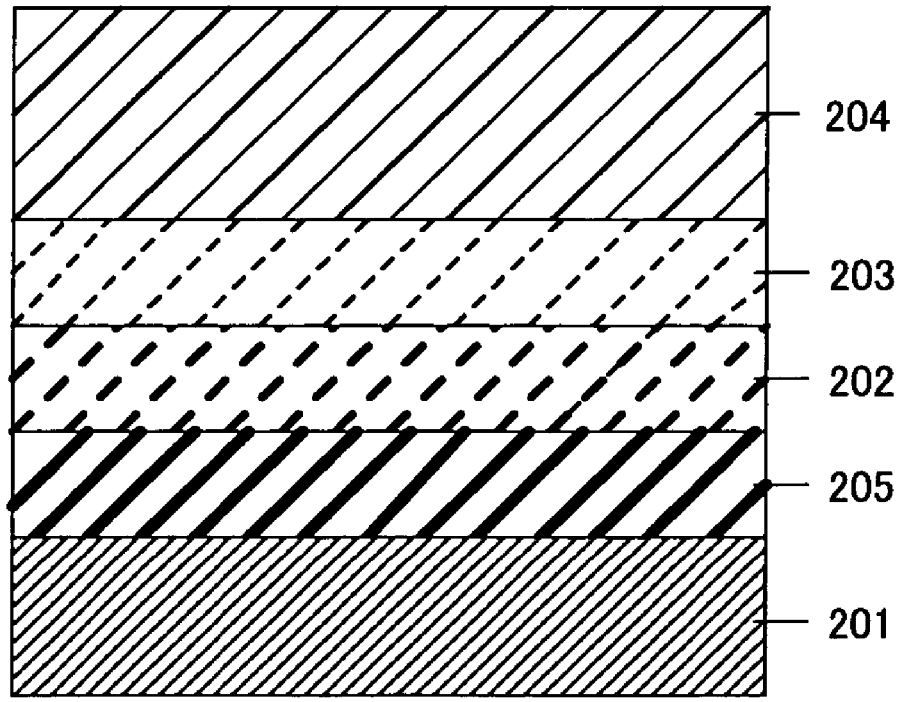
FIG. 2 is a cross-sectional view schematically showing another example of the latent electrostatic image bearing member of the present invention.

FIG. 2 is a cross-sectional view showing another example of embodiments of the latent electrostatic image bearing member of the present invention. The latent electrostatic image bearing member takes a structure in which a charge blocking layer 205, a moiré preventing layer 202, a charge generating layer 203, and a charge transporting layer 204 are formed in this order on or above a support 201.

The latent electrostatic image bearing member of the present invention can take any one of embodiments shown in FIG. 1 and FIG. 2, however, the embodiment shown in FIG. 2 is particularly preferable for its highly durability.

<Charge Transporting Layer>

The charge transporting layer contains at least a charge transporting material and a binder resin, and further contains other components in accordance with the necessity.

The thickness of the charge transporting layer is 30 μm to 50 μm, and more preferably 35 μm to 45 μm. When the thickness of the charge transporting layer is less than 30 μm, the durability of the latent electrostatic image bearing member may be degraded, and when the thickness of the charge transporting layer is more than 50 μm, the resolution may be degraded.

Figure 3:
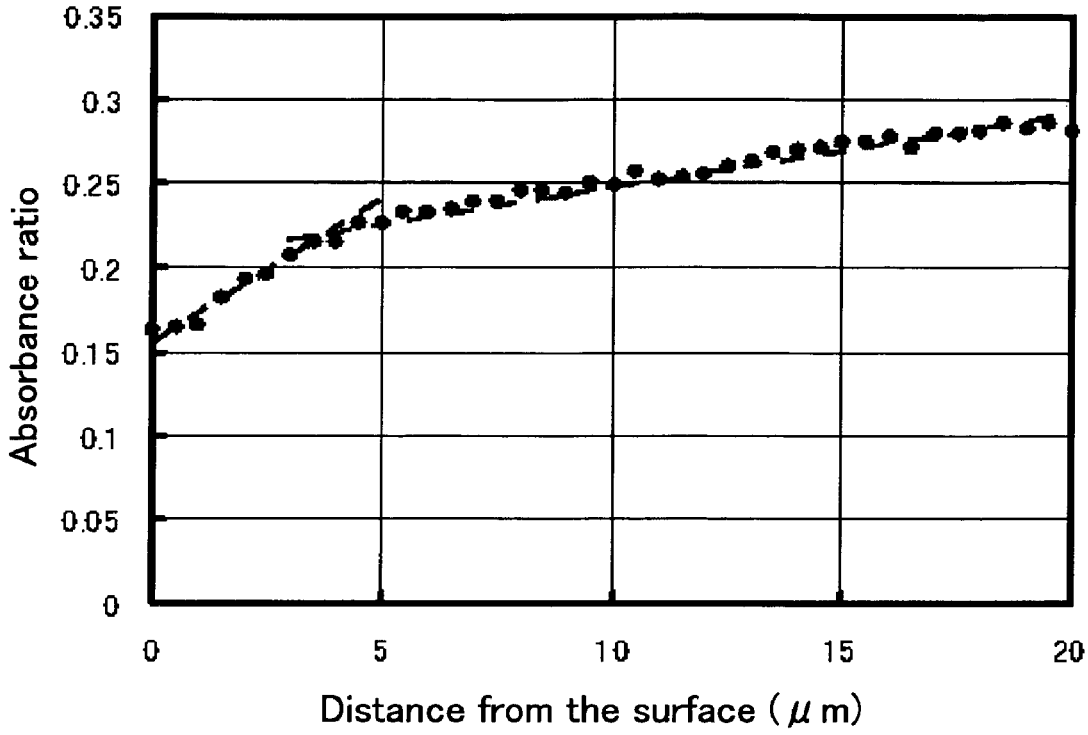
FIG. 3 is a view showing a distribution representing the relation between the absorbance ratio of a charge transporting material and the binder resin in a charge transporting layer of a conventional latent electrostatic image bearing member measured by infrared spectroscopy and the distance from the surface of the charge transporting layer toward the thickness of the charge transporting layer.

It is found that when the charge transporting layer is formed so as to have a thickness of 30 μm or more, the binder resin is unevenly deposited in about 5 μm inside from the surface of the charge transporting layer, and a distribution representing the relation between the absorbance ratio of the major peak of the charge transporting material and the major peak of the binder resin measured by infrared spectroscopy and the distance from the surface of the charge transporting layer in the thickness direction thereof has inflection points as shown in FIG. 3.

The reason why the distribution representing the relation between the absorbance ratio of the charge transporting material and the binder resin and the distance in the thickness direction of the charge transporting layer has inflection points is uncertain, however, it is assumed that the reason is attributable to the compatibility between the non-halogen solvent and the binder resin and to the evaporation rate of the solvent. Particularly when the binder resin used in an electrophotographic photoconductor is unevenly deposited, the binder resin in the charge transporting layer is easily soluble as a simulant to binder resin and wax used in a toner, and because of a high content of the binder resin in the charge transporting layer, the mechanical durability is increased, and thus it causes less abrasion of the charge transporting layer even when the latent electrostatic image bearing member is repeatedly used. It is conceivable that the binder resin in the charge transporting layer and the binder resin and wax in the toner are easily fixed to each other due to the above-mentioned reasons, thereby causing toner filming, and this leads to abnormal images.

Figure 4:
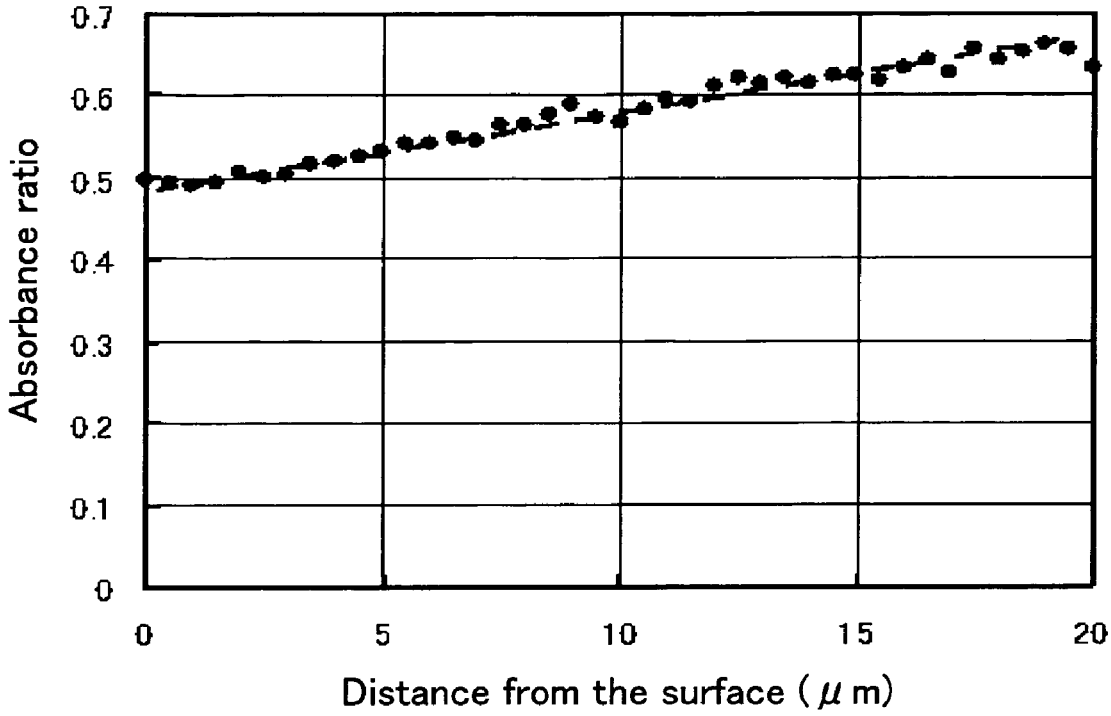
FIG. 4 is a view showing a distribution representing the relation between the absorbance ratio of a charge transporting material and the binder resin in a charge transporting layer of the latent electrostatic image bearing member of the present invention measured by infrared spectroscopy and the distance from the surface of the charge transporting layer toward the thickness of the charge transporting layer.

In the present invention, a distribution representing the relation between the absorbance ratio of the charge transporting material and the binder resin measured by infrared spectroscopy and the distance from the surface of the charge transporting layer toward the thickness thereof represents a generally linear shape without having inflection points within 20 μm from the surface of the charge transporting layer toward the thickness thereof, as shown in FIG. 4.

This has the same meaning that the square of a correlation coefficient "r" between the absorbance ratio of the charge transporting material and the binder resin measured by infrared spectroscopy and the distance from the surface of the charge transporting layer toward the thickness thereof is 0.92 or more within 20 μm from the surface of the charge transporting layer toward the thickness thereof. The square of a correlation coefficient is preferably 0.93 or more. When the square of a correlation coefficient "r" is less than 0.92, the binder resin used in the charge transporting layer and the binder resin and wax used in the toner are easily fixed to each other to cause toner filming and then to cause abnormal images.

Here, the correlation coefficient "r" can be determined from the following equation.

$$r = \sum_{i=1}^{x} (x_i - \bar{x})(y_i - \bar{y}) \Big/ \left( \sqrt{\sum_{i=1}^{x} (x_i - \bar{x})^2} \sqrt{\sum_{i=1}^{x} (y_i - \bar{y})^2} \right)$$

In the equation, $\bar{x}$ and $\bar{y}$ are represented by the following equations: "$x_i$" represents the distance from the surface of the charge transporting layer toward the thickness of the charge transporting layer. "$y_i$" represents an absorbance ratio of the charge transporting material and the binder resin. "n" is a measured value of an integer of two or more.

$$\bar{x} = \sum_{i=1}^{x} x_i / n$$

$$\bar{y} = \sum_{i=1}^{x} y_i / n$$

Specifically, (1) using spreadsheet software, Excel (available from Microsoft Corporation, a value of the distance from the charge transporting layer toward the thickness of the charge transporting layer is input as X axis, and a value of the absorbance ratio of the charge transporting material and the binder resin measured by infrared spectroscopy is input as Y axis. (2) A scatter chart is prepared by utilizing Excel graph function. (3) Approximate curves are sought, and the most approximate line shape is selected from among the curves to thereby calculate a squared value of a correlation coefficient.

In the present invention, an absorbance ratio A between the charge transporting material and the binder resin in the surface of the charge transporting layer measured by infrared spectroscopy, and an absorbance ratio B between the charge transporting material and the binder resin at 5 μm inside from the surface of the charge transporting layer measured by infrared spectroscopy satisfy the equation, B/A=1.0 to 1.15, and more preferably 1.0 to 1.1. A photoconductor satisfying the value B/A less than 1.0 is hardly obtained under a normal condition for preparation. However, when the value B/A is less than 1.0, cracks may easily occur in the surface of the charge transporting layer, and when the value B/A is more than 1.15, the binder resin used in the charge transporting layer and the binder resin and wax used in toner are easily fixed to each other, and this may cause toner filming and thereby cause abnormal images.

The reason of resulting in the above-noted value B/A is uncertain, however, it is assumed that the reason is attributable to compatibility between the non-halogen solvent and the binder resin, and the evaporation rate of the solvent.

It is possible to obtain a distribution between the absorbance ration and the distance having a generally linear shape within 20 μm from the surface of the transporting layer toward the thickness thereof without having inflection points (to obtain a square of a correlation coefficient of 0.92 or more), as shown in FIG. 4, or it is possible to obtain a latent electrostatic image bearing member that the an absorbance ratio A of the charge transporting material and the binder resin in the surface of the charge transporting layer measured by infrared spectroscopy and the absorbance ratio B between the charge transporting material and the binder resin at 5 μm inside from the surface of the charge transporting layer satisfy the equation B/A=1.0 to 1.15, by applying a coating solution for charge transporting layer containing at least a charge transporting material, a binder resin, and a non-halogen solvent over the surface of a charge generating layer, drying the surface of the charge generating layer with the coating solution applied thereon to form a charge transporting layer, and subjecting the charge transporting layer to a surface treatment such as a heat treatment, a UV irradiation treatment, an electron beam irradiation treatment, and a corona discharge treatment. This will be explained in detail hereinafter.

The absorbance ratio of the charge transporting material and the binder resin measured by infrared spectroscopy can be determined by the following procedure. First, the absorption spectrum of the charge transporting layer is measured, and the absorbance ratio can be determined from the major peak of the charge transporting material and the major peak of the binder resin. The major peak does not exist when the peak of the charge generating material and the peak of the binder resin have the same frequency, and it is preferable to select a peak showing a higher absorbance because a high S/N ratio (signal to noise ratio) can be obtained.

Examples of a measuring device of the absorption spectrum include Fourier transform infrared (FT-IR) spectrometers, or energy-dispersive infrared spectrometers. For the method for measuring the absorption spectrum, transmission method or attenuated total reflectance (ATR) is used, of these, the ATR method is particularly preferable for the excellent resolution toward the thickness direction of the charge transporting layer.

Specifically, the distribution of the absorbance ratio of the charge transporting layer in the depth direction can be obtained by obtaining a relation between the reduced amount of the thickness thereof and the absorbance ratio by using an image forming apparatus, grinder, etc. For example, the distribution of the absorbance ration can be obtained by the following procedure. First, a small amount of the charge transporting layer is cut out in the oblique direction from the surface using a surface and interface cutting analyzer (SAICAS, DN-20, available from DAIPLA WINTES Co., Ltd.), the absorbance ratio of the oblique portion is determined by μ-ATR method, and the distribution in the depth direction can be obtained from the absorbance ratio.

The charge transporting layer can be formed by applying a coating solution for charge transporting layer in which a charge transporting material and a binder resin are dissolved or dispersed in an appropriate solvent, over the surface of the charge generating layer, and drying the applied surface. To the coating solution for charge transporting layer, a plasticizer, a leveling agent, an anti-oxidizing agent, etc. can be added.

The charge transporting material can be broadly classified into positive-hole transporting materials and electron transporting materials. Each of these charge transporting materials may be used alone or in combination with two or more.

The electron transporting materials are not particularly limited, may be. suitably selected in accordance with the intended use, and examples thereof include chloranil, bromoanil, tetracyanoethylene, tetracyanoquinodimethane, 2,4,7-trinitro-9-fluolenone, 2,4,5,7-tetranitro-9-fluolenone, 2,4,5, 7-tetranitroxanthone, 2,4,8-trinitorothioxanthone, 2,6,8-trinitro-4H-indeno[1,2-b]thiophene-4-on, 1,3,7-trinitrodibenzothiophene-5,5-dioxide, and benzoquinone derivatives.

The positive-hole transporting materials are not particularly limited, may be suitably selected in accordance with the intended use, and examples thereof include poly-N-vinylcarbazole or derivatives thereof, poly-γ-ethylcalbazolylglutamate or derivatives thereof, pyrene-formaldehyde condensates or derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrozone derivatives, indene derivatives, butadiene derivatives, pyrene derivatives, bisstilbene derivatives, and enamine derivatives.

The binder resin is not particularly limited, may be suitably selected in accordance with the intended use, and examples thereof include polystyrene resins, styrene-acrylonitrile copolymers, styrene-butadiene copolymers, styrene-maleic acid anhydride copolymers, polyester resins, polyvinyl chloride resins, vinylchloride-vinyl acetate copolymers, polyvinyl acetate resins, polyvinylidene chloride resins, polyarates, phenoxy resins, polycarbonate resins, acetylcellulose, ethylcellulose, polyvinyl butyral, polyvinylformal, polyvinyltoluene, poly-N-vinylcarbazole, acrylic resins, silicone resins, epoxy resins, melamine resins, urethane resins, phenol resins, and alkyd resins. Each of these positive-hole transporting materials may be used alone or in combination with two or more.

The content of the charge transporting material is not particularly limited and may be suitably selected in accordance with the intended use, however, it is preferably 20 parts by mass to 300 parts by mass, and more preferably 40 parts by mass to 150 parts by mass relative to 100 parts by mass of the binder resin.

<Support>

The support is not particularly limited and may be suitably selected in accordance with the intended use as long as it exhibits conductivity of a volume resistance of $10^{10}$ Ω·cm or less, and examples thereof include (1) film-like or cylindrical plastic or paper coated with a metal oxide such as aluminum, nickel, chrome, nichrome, copper, gold, silver, and platinum by vapor deposition or sputtering; (2) a tube which is prepared by drawing or extruding a plate made of aluminum, aluminum alloy, nickel, and/or stainless and subjecting the surface of the tube to a surface treatment such as cutting, superfinishing, and grinding; (3) an endless nickel belt or an endless stainless belt disclosed in Japanese Patent Application Laid-Open (JP-A) No. 52-36016; and (4) the one that a surface of a nickel foil having a thickness of 50 μm to 150 μm or a polyethylene terephthalate (PET) film has been subjected to a conducting coat such as aluminum vapor deposition or the like.

In addition, it is possible to use the one that a solution in which a conductive power and a binder resin are dispersed in a solvent is applied over the surface of the support.

The conductive powder is not particularly limited, may be suitably selected in accordance with the intended use, and examples thereof include carbon black, acetylene black; metal powder made of aluminum, nickel, iron, nichrome, copper, zinc, and silver; and metal oxides such as conductive tin oxides and ITO. Each of these conductive powers may be used alone or in combination with two or more.

The binder resin is not particularly limited, may be suitably selected in accordance with the intended use, and examples thereof include polystyrene resins, styrene-acrylonitrile copolymers, styrene-butadiene copolymers, styrene-maleic acid anhydride copolymers, polyester reins, polyvinyl chloride resins, vinyl chloride-vinyl acetate copolymers, polyvinyl acetate resins, polyvinylidene chloride resins, polyarylate resins, phenoxy resins, polycarbonate resins, acetylcellulose resins, ethyl cellulose resins, polyvinyl butyral resins, polyvinylformal resins, polyvinyl toluene resins, poly-N-vinylcarbazole resins, acrylic resins, silicone resins, epoxy resins, melamine resins, urethane resins, phenol resins, and alkyd resins. Each of these binder resins may be used alone or in combination with two or more.

The solvent is not particularly limited, may be suitably selected in accordance with the intended use, and examples thereof include tetrahydrofuran, dichloromethane, methylethylketone, and toluene.

It is also possible to preferably use, as a conductive support, the one having a cylindrical base, and a conductive layer made of a heat-shrinkable tube in which the conductive powder is contained in a material such as polyvinyl chloride, polypropylene, polyester, polystyrene, polyvinylidene chloride, polyethylene, chlorinated rubber, TEFLON (registered) on the cylindrical base.

<Charge Blocking Layer>

The charge blocking layer preferably exhibit insulating properties and is insoluble in a coating solution for moiré preventing layer and a coating solution for photosensitive layer. Mylon resins are preferably used. Among nylon resins, N-alkoxymethylated nylon is particularly preferable in terms of solubility to coating solutions and environmental stability.

The charge blocking layer is a layer having a function to prevent antipolar charge induced from electrodes (conductive support) at the time of charging the photoconductor from being injected from the support into the photoconductor. In the case of a negative charge, the charge blocking layer functions to prevent a positive-hole charge from being injected into the photoconductor, and in the case of a positive charge, the charge blocking layer functions to prevent a negatively charged electron being injected into the photoconductor.

A conductive polymer having charge-rectifying property and an acceptor-functioning or donator-functioning resin or compound may be added as raw materials of the charge blocking layer according to the charge polarity to thereby provide with a function to control and prevent injection of charge from the support.

The charge blocking layer can be formed by applying a coating solution for charge blocking layer over the surface of a support. To the coating solution for charge blocking layer, agents necessary for curing (crosslinking), solvents, additives, and curing accelerators are added, and a charge blocking layer is formed on the support in the common procedure by blade coating, immersion coating, spray coating, beat coating, or nozzle-coating. After the coating, the surface of the support coated with the coating solution for charge blocking layer is dried or cured by means of a curing treatment such as drying, heating, and irradiation of light.

For the solvent, an alcohol solvent is preferably used. Examples of the alcohol solvent include methanols, ethanols, propanols, and butanols. Each of these solvents may be used alone or in combination with two or more.

The thickness of the charge blocking layer is not particularly limited, may be suitably selected in accordance with the intended use, however, it is preferably 0.1 μm to 3.0 μm, and more preferably 0.5 μm to 2.0 μm. When the thickness of the charge blocking layer is more than 3.0 μm, the residual potential may be significantly increased particularly under a condition of low-temperature and low humidity due to repeated actions of charging and exposing. When the thickness of the charge blocking layer is less than 0.1 μm, the effect of blocking property may be reduced.

<Moiré Preventing Layer>

The moiré preventing layer is a layer having a function to preventing occurrences of a moiré image caused by optical interference inside the photosensitive layer when writing information using coherent light like laser beam. Basically, the moiré preventing layer has a function to generate light scattering of the write light. To develop such a function, it is effective for the moiré preventing layer to have a material having a high refractive index.

The moiré preventing layer contains at least an inorganic pigment and a binder resin, and further contains other components in accordance with the necessity.

The inorganic pigment is not particularly limited, may be suitably selected in accordance with the intended use, however, white pigments are preferably used. Examples of the white pigments include titanium oxides, calcium fluorides, calcium oxides, silicon oxides, magnesium oxides, and aluminum oxides. The content of white pigment as the inorganic pigment in the moiré preventing layer is preferably 30% by volume to 75% by volume.

When the moiré preventing layer contains at least titanium oxide with a purity of 99.0% or more and a crosslinkable resin, it is possible to obtain an image having substantially less reduction in charge amount which is accompanied by repeated fatigue, without having a substantial amount of background smear.

A titanium oxide with a purity of 99.0% or more can be produced by the method called chlorination in which a raw material of titanium slag is chlorinated by using chlorine to make it into titanium tetrachloride; the titanium tetrachloride is centrifugalized, condensed, refined, and then oxidized to yield a titanium oxide; and the titanium oxide is crushed, and classified, filtered, washed, dried, and pulverized to thereby yield a titanium oxide with purity of 99.0% or more. Primary impurities in the titanium oxide are hydroscopic materials and ionic materials such as $Na_2O$ and $K_2O$. The purity can be determined by a measurement method described in JIS K5116.

For the crosslinkable resin, heat-curable resins are preferably used. In particular, a mixture of an alkyd resin and a melamine resin is most preferably used. In this case, the mixture ratio of an alkyd resin and a melamine resin is one important factor that determines the structure and properties of the moiré preventing layer. The preferred mixture ratio (mass ratio) (alkyd resin/melamine resin) is ranging from 5/5 to 8/2. When a melamine resin of more than 5/5 is mixed, it is unfavorable because the volume shrinkage of the moiré preventing layer is increased at the time of heat-curing to easily cause coating failures, and the residual potential of the photoconductor tends to be increased. When an alkyd resin of more than 8/2 is mixed, it may cause a substantial amount of background smear due to excessively lowered bulk resistance, although it is effective in reducing the residual potential of the photoconductor.

For the method of forming the moiré preventing layer, wet coating is employed, however, when a charge blocking layer is formed as an underlayer of the moiré preventing layer, it is preferable to use a solvent that does not erode the charge blocking layer.

The thickness of the moiré preventing layer is not particularly limited and may be suitably selected in accordance with the intended use, however, it is preferably 1 μm to 10 μm, and more preferably 2 μm to 5 μm. When the thickness of the moiré preventing layer is less than 1 μm, the expression of effect of the moiré preventing layer may be reduced, and when the thickness thereof is more than 10 μm, residual potential may be accumulated on the photoconductor.

<Charge Generating Layer>

The charge generation layer contains at least a charge generating material and further contains other components in accordance with the necessity.

The charge generating material is not particularly limited, may be suitably selected in accordance with the intended use, and examples thereof include metal phthalocyanines such as titanylphthalocyanine and chlorogallium phthalocyanine; metal-free phthalocyanine, azulenium salt pigments, squaric acid methine pigments, symmetric or asymmetric azo pigments having a carbazole skeleton, symmetric or asymmetric azo pigments having a triphenylamine skeleton, symmetric or asymmetric azo pigments having a diphenylamine skeleton, symmetric or asymmetric azo pigments having a dibenzothiophene skeleton, symmetric or asymmetric azo pigments having a fluorenone skeleton, symmetric or asymmetric azo pigments having an oxadiazole skeleton, symmetric or asymmetric azo pigments having a bisstilbene skeleton, symmetric or asymmetric azo pigments having a distyryloxadiazole skeleton, symmetric or asymmetric azo pigments having a distyrylcarbozole skeleton, perylene pigments, anthraquinone pigments, polycyclic quinone pigments, quinoneimine pigments, diphenylmethane pigments, triphenylmethane pigments, benzoquinone pigments, naphthoquinone pigments, cyanine pigments, azomethine pigments, indigoid pigments, and bisbenzimidazole pigments. Each of these charge generating materials may be used alone or in combination with two or more.

Examples of the phthalocyanine pigments include metal-free phthalocyanines or metal phthalocyanines. The phthalocyanines can be synthesized by the synthesis method described in Moser and Thomas "Phthalocyanine Compounds" (Reinhold Publishing Corp. 1963) or other appropriate methods.

Examples of the metal phthalocyanines include those having a central metal of copper, silver, beryllium, magnesium, calcium, zinc, indium, sodium, lithium, titanium, tin, lead, vanadium, chrome, manganese, iron, cobalt, and the like. In the core of the phthalocyanine, a halogenated metal having a tertiary or more atomic value may exist instead of the metal atom. Various phthalocyanine crystal shapes are known, however, it is possible to use known crystal shapes such as α-form, β-form, Y-form, ε-form, τ-form, and X-form; and amorphous forms. Of these, titanylphthalocyanine having titanium as the central metal, represented by the following General Formula (hereinafter may be referred to as TiOPc) is particularly preferable for its high sensitivity and excellent properties.

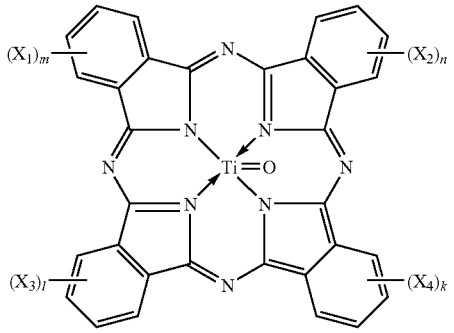

In the General Formula, $X_1$, $X_2$, $X_3$, and $X_4$ individually represent one of various halogen atoms; and "n", "m", "l", and "k" individually represent an integer of zero to 4.

Among the titanylphthalocyanines, a titanylphthalocyanine is used which has a highest diffraction peak, as the Bragg angle 2θ diffraction peak relative to CuKα having a wavelength of 15.42 nm, at least at 27.2 degrees, further has primary peaks at 9.4 degrees, 9.6 degrees, 24.0 degrees, and a peak at 7.3 degrees as the diffraction peak of the lowest angle side, but has no peak between the peak at 7.3 degrees and the peak at 9.4 degrees, and has no peak at 26.3 degrees.

The crystalline titanylphthalocyanines are described in Japanese Patent Application Laid-Open (JP-A) No. 2001-19871. By using such a crystalline titanylphthalocyanine, it is possible to obtain a stable electrophotographic photoconductor which does not cause reductions in chargeability without losing high sensitivity even when the photoconductor is repeatedly used. However, when a photoconductor was repeatedly used over a very long period of time, it caused increased amounts of background smear, and the operating life of photoconductor left much to be desired. This is assumed to be caused by inability to address problems with background smear caused by charge injected from a support, even though problems with background smear caused by a charge generating layer can be solved.

With a photoconductor using a crystalline titanylphthalocyanine having an average primary particle size of 0.25 μm or less, the sensitivity is significantly increased, and the property to prevent occurrence of background smear is remarkably improved. Thus, for a charge generating material used for the electrophotographic photoconductor of the present invention, a titanylphthalocyanine having the above-noted crystal shape and a controlled primary particle size is the most useful.

A structure in which two or more undercoat layers or intermediate layers are multilayered between a support and a photosensitive layer is a technique described in Japanese Patent Application Laid Open (JP-A) NO. 05-80572, however, the multilayered laminate incorporating a photosensitive layer having high sensitivity largely affects the occurrence of heated carrier in the photosensitive layer, and such a photoconductor cannot fully prevent occurrences of background smear. This tendency is obvious and problematic when a charge generating layer having absorption spectra at long wavelengths which is typified by titanylphthalocyanine used in the present invention, is used.

As mentioned above, the method of preventing occurrences of background smear in a charge generating layer or an. undercoat layer has been disclosed, however, there are a plurality of triggers to cause background smear, and thus it is impossible for a photoconductor to endure a situation of being repeatedly used over a long period of time unless these triggers are prevented at the same time. The triggers of back ground smear are of no significance at first and are not problematic at the early stage, however, when a photoconductor is repeatedly used, the photoconductor fatigues, and with advanced deterioration of the used component materials, triggers of background smear grow. Thus, it is needed to eliminate triggers of background smear as much as possible and to increase the stability to fatigue of a repeatedly used photoconductor. However, a method by which these triggers can be eliminated to give spectacularly high-durability to a photoconductor has not been disclosed yet.

Next, a synthesis method of a titanylphthalocyanine crystal having a specific crystal shape used in the present invention will be described below.

First, a synthesis method of a composition of the titanylphthalocyanine crystal will be described. Synthesis methods of phthalocyanines have been known from a long time ago and are described in "Phthalocyanine Compound" (1963) and "The Phthalocyanines" (1983) by Moser et al., and Japanese Patent Application Laid Open (JP-A) No. 06-293769.

For example, a first method of synthesizing a titanylphthalocyanine crystal is that a mixture of phthalic acid anhydrides, metal or halogenated metal, and urea is heated in the presence or absence of a high-boiling point solvent. In this method, a catalyst of ammonium molybdate or the like is concurrently used in accordance with the necessity.

A second synthesis method is that phthalonitriles and halogenated metal are heated in the presence or absence of a high-boiling point solvent. This method is used for phthalocyanines that cannot be produced by the first synthesis method such as for aluminum phthalocyanines, indium phthalocyanines, oxovanadium phthalocyanines, oxotitanium phthalocyanines, and zirconium phthalocyanines.

A third synthesis method is that a phthalic acid anhydride or phthalonitriles and ammonia are reacted to each other to yield an intermediate, for example, 1,3-diiminoisoindolines or the like, and then the intermediate and halogenated metal are reacted to each other in a high-boiling point solvent.

A fourth synthesis method is that phthalonitriles and a metal alkoxide are reacted to each other in the presence of urea or the like.

Of these synthesis methods, the fourth method is a vary useful method as a synthesis method for electrophotographic materials because the method does not cause chlorination (halogenation) of benzene ring.

As the synthesis method of a titanylphthalocyanine crystal, a method in which halogenated titanium is not used as a raw material, as described in Japanese Patent Application Laid Open (JP-A) No. 06-293769, is preferably used. The maximum merit of the method is that a synthesized titanylphthalocyanine crystal is free from halogenation. When a titanylphthalocyanine crystal containing a halogenated titanylphthalocyanine crystal as impurities is used for a photoconductor, in many cases, it has adverse effect such as reductions in light sensitivity and in chargeability as electrostatic properties of the photoconductor (on page 103 of paper "Japan Hardcopy" 1989). In the present invention, a titanylphthalocyanine crystal which is free from halogenation as described in Japanese Patent Application Laid Open (JP-A) No. 2001-19871 is also mainly intended to use, and these materials are effectively used. Synthesis of a titanylphthalocyanine which is free from halogenation needs not to use halogenated materials as raw materials at the time of synthesis of titanylphthalocyanine. Specifically, a specific method described below can be used.

Then, a synthesis method of an indefinitely shaped titanylphthalocyanine (low-crystallinity titanylphthalocyanine) will be described below. The method is a method in which phthalocyanines are dissolved in sulfuric acid, and the solution is diluted with water to thereby reprecipitate an indefinitely shaped titanylphthalocyanine; and a so-called acid paste method or acid slurry method can be used.

Specifically, in the method, the above-noted coarse synthetic product is dissolved in a dense sulfuric acid which is 10-times to 50-times the volume of the synthetic product, impurities therein are removed by filtration or the like in accordance with the necessity, and the solution is then slowly poured in sufficiently cooled water or ice water in a volume of 10-times to 50-times the volume of the sulfuric acid to reprecipitate a titanylphthalocyanine. The precipitated titanylphthalocyanine is filtered, washed with ion exchange water and then filtered, and the procedure is repeatedly performed until the filtrate is neutral. Finally, the filtrate is washed with pure ion exchange water and filtered to thereby yield a water paste in a solid concentration of about 5% by mass to 15% by mass.

In the procedure, it is important that the filtrate is sufficiently washed with ion exchange water so as to remove the dense sulfuric acid to the extent possible. Specifically, it is preferable that the ion exchange water after washing treatment shows physical properties as stated below. The residual volume of the sulfuric acid, if quantitatively represented, can be represented by pH or specific conductivity of the washed ion exchange water. When the residue of sulfuric acid is represented by pH, it is preferably ranging from 6 pH to 8 pH. When the residual volume of sulfuric acid is within the range, it can be judged as a residual volume of sulfuric acid that will not negatively affect the properties of the photoconductor. The pH value can be measured in a simple procedure using a commercially available pH measuring device.

In the meantime, the specific conductivity is preferably 8 μS/cm or less, more preferably 5 μS/cm or less and still more preferably 3 μS/cm or less. When the specific conductivity is within the range, it can be judged as a residual volume of sulfuric acid that will not negatively affect the properties of the photoconductor. The specific conductivity can be measured using a commercially available electric conductivity measuring device. The lower limit of the specific conductivity is a specific conductivity of the ion exchange water used in washing. In any of the measurements of the pH value and the specific conductivity, when resultant values of pH and specific conductivity which deviate from the above-noted ranges, the chargeability of the photoconductor may be reduced, and the sensitivity thereof may be degraded due to the excessive residual volume of sulfuric acid.

The thus prepared titanylphthalocyanine is an indefinitely shaped titanylphthalocyanine (low-crystallinity titanylphthalocyanine) used in the present invention. Here, the indefinitely shaped titanylphthalocyanine (low-crystallinity titanylphthalocyanine) preferably has a highest diffraction peak, as the Bragg angle 2θ diffraction peak of 0.2 degrees relative to characteristic X-rays of CuKα having a wavelength of 15.42 nm, at least between 7.0 degrees to 7.5 degrees, and it is more preferably the half width of the diffraction peak is 1 degree or more. Further, the average primary particle size is preferably 1 μm or less.

The conversion of crystal is a step for converting the indefinitely shaped titanylphthalocyanine (low-crystallinity titanylphthalocyanine) into a titanylphthalocyanine crystal having a highest diffraction peak, as the Bragg angle 2θ diffraction peak of 0.2 degrees relative to characteristic X-rays of CuKα having a wavelength of 15.42 nm, at least at 27.2 degrees, further has primary peaks at 9.4 degrees, 9.6 degrees, 24.0 degrees, and a peak at 7.3 degrees as the diffraction peak of the lowest angle side, but has no peak between the peak at 7.3 degrees and the peak at 9.4 degrees, and has no peak at 26.3 degrees.

Specifically, the indefinitely shaped titanylphthalocyanine (low-crystallinity titanylphthalocyanine) is mixed with an organic solvent under the presence of water, instead of dying the indefinitely shaped titanylphthalocyanine, and the mixture is stirred to thereby yield the crystal.

The organic solvent to be used here is not particularly limited, may be suitably selected from among organic solvents known in the art in accordance with the intended use, provided that it allows obtaining a desired crystal shape. Examples thereof include tetrahydrofuran, toluene, methylene chloride, carbon disulfide, orthodichlorobenzene, and 1,1,2-trichloroethane. Each of these organic solvents may be used alone or in combination with two or more.

The mass of the organic solvent used in the conversion of crystal is preferably 30-time the mass of the indefinitely shaped titanylphthalocyanine. This is because the mass ratio allows the conversion of crystal to happen quickly and sufficiently as well as to cause the effect of sufficiently removing impurities contained in the indefinitely shaped titanylphthalocyanine. The indefinitely shaped titanylphthalocyanine used here is prepared by an acid paste method, and it is preferred to use a titanylphthalocyanine that sulfuric acid is sufficiently washed, as described above. When a titanylphthalocyanine crystal is converted under the condition where sulfuric acid remains, sulfate ions are left in crystal particles, and the sulfate ions cannot be removed completely even after the yielded crystal is subjected to a washing treatment. When sulfate ions are left in crystal particles, it causes reductions in sensitivity and chargeability of the photoconductor, and favorable results cannot be obtained. For example, Japanese Patent Application Laid Open (JP-A) No. 08-110649 (comparative example) describes a method in which a titanylphthalocyanine dissolved in sulfuric acid is poured along with ion exchange water to an organic solvent to thereby perform a conversion of crystal. In the method, a crystal having an X-ray diffraction spectrum similar to that of a titanylphthalocyanine which is obtainable in the present invention can be yielded, however, the sulfate ion concentration in the titanylphthalocyanine is high, and the light attenuation (light sensitivity) is poor, and thus the method is not preferable as the method of preparing a titanylphthalocyanine to be used in the present invention.

The crystal conversion method explained above is a crystal conversion method according to Japanese Patent Application Laid Open (JP-A) No. 2001-19871. In the charge generating material contained in the latent electrostatic image bearing member of the present invention, the effect can be further exhibited by forming the particle size of titanylphthalocyanine crystal smaller, and the preparation methods will be described below.

The methods for controlling the particle size of titanylphthalocyanine crystal contained in the charge generating layer are broadly categorized into two methods. The one is a method in which a crystal containing no particles having a particle diameter greater than 0.25 μm is synthesized when titanylphthalocyanine crystal particles are synthesized. The other is a method in which after a dispersion of titanylphthalocyanine crystal, coarse particles having a particle diameter greater than 0.25 μm are removed. The two methods can be concurrently used.

Next, a synthesis method of a particulate titanylphthalocyanine crystal will be described below. First, to make the particle size of a titanylphthalocyanine crystal smaller, the indefinitely shaped titanylphthalocyanine (low-crystallinity titanylphthalocyanine) needs to have a primary particle diameter of 0.1 μm or less (almost all the particles have a primary particle diameter of around 0.01 μm to 0.05 μm) (see FIG. 5, the scale bar shown in the figure has a length of 0.2 μm), however, at the time of converting crystal, it was found that the crystal was converted with growth of crystal particles. Typically, in this type of crystal conversion, a sufficient time of crystal conversion is taken so as not to leave residue of raw materials, a crystal conversion treatment is fully performed, and the crystal is filtered to yield a titanylphthalocyanine crystal having a desired crystal shape. For the reason, although a raw material having a sufficiently small primary particle diameter is used, for a titanylphthalocyanine crystal after being subjecting a crystal conversion treatment, crystal particles having a relatively large primary particle diameter (about 0.3 μm to 0.5 μm) can be obtained (see FIG. 6, the scale bar shown in the figure has a length of 0.2 μm).

When dispersing the thus prepared titanylphthalocyanine crystal, the crystal is dispersed by applying a strong shearing force to obtain dispersed crystal particles having a small particle size (around particles size of 0.2 μm or less), and then the crystal further dispersed by applying strong energy for pulverizing primary particles in accordance with the necessity. As the result, as described above, a small proportion of particles are transformed to crystal shapes other than a desired crystal shape.

Figure 5:
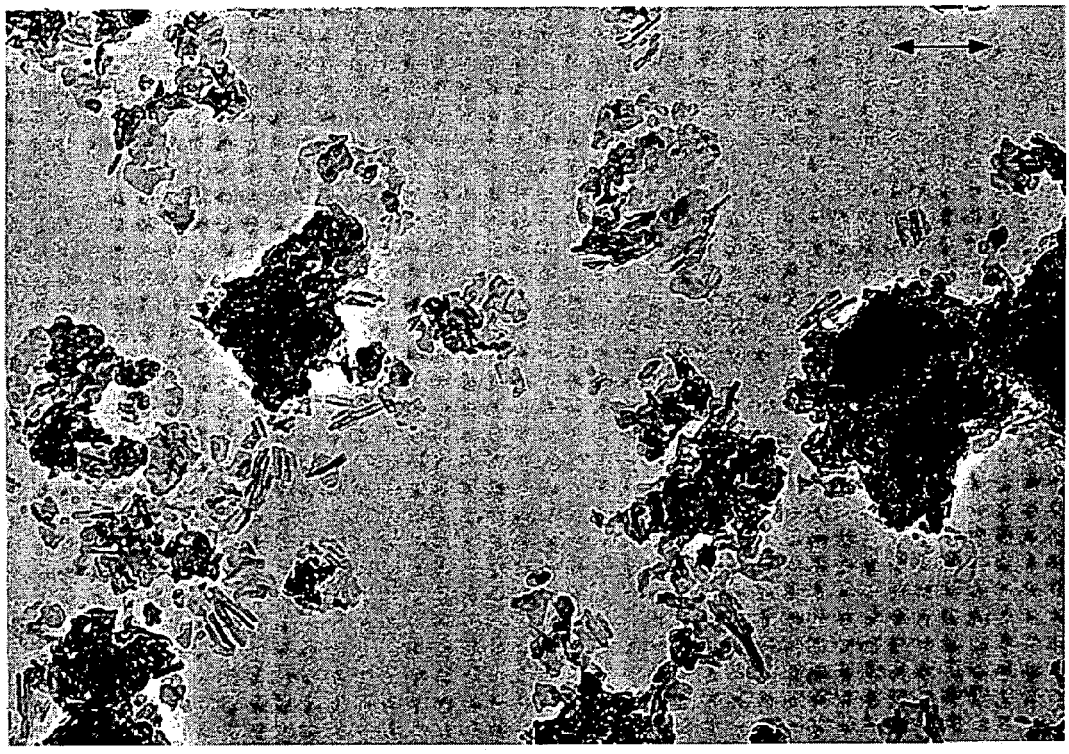
FIG. 5 is a transmission electron microscopic image of indefinitely shaped titanylphthalocyanine. The scale bar shown in the figure has a length of 0.2 μm.
Figure 6:
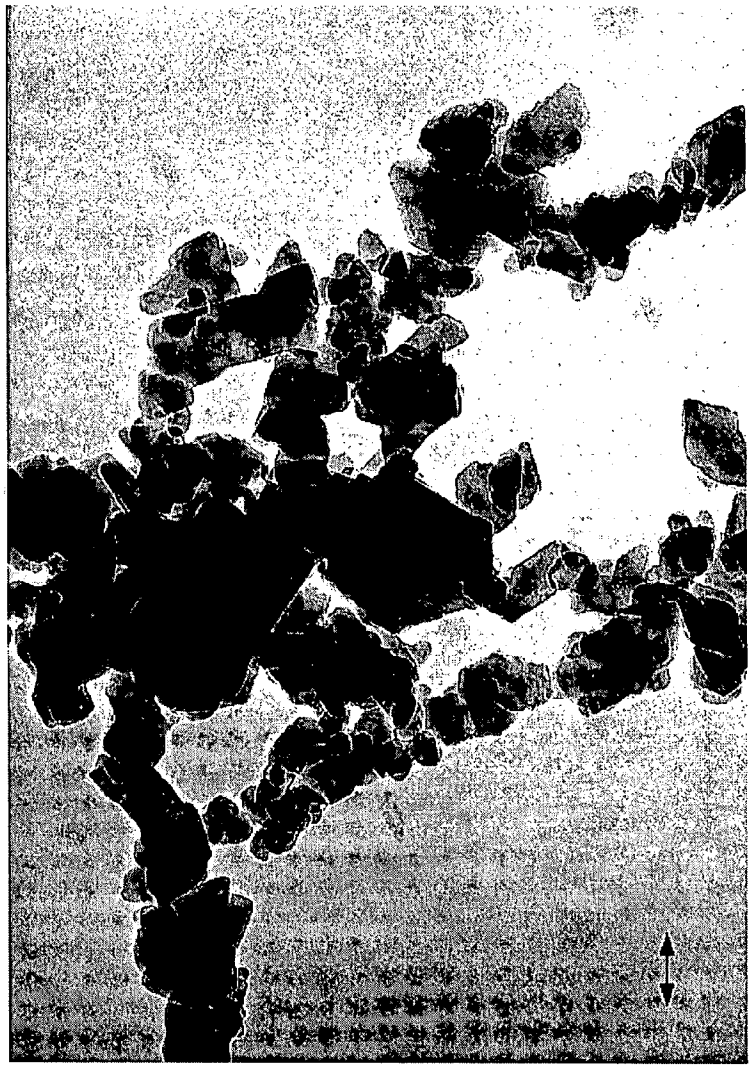
FIG. 6 is a transmission electron microscopic image of titanylphthalocyanine after being subjected to a converting crystal treatment. The scale bar shown in the figure has a length of 0.2 μm.

In contrast, the present invention aims at obtaining a titanylphthalocyanine crystal having a primary particle size which is as small as possible by choosing a timing to complete the crystal conversion treatment within the time range where the crystal is hardly grown any more in crystal conversion (within the time range where the size of an indefinitely shaped titanylphthalocyanine particles observed in FIG. 5 that has been subjected to a crystal conversion is kept to have a satisfactory smallness, about 0.2 μm or less). The particle size of titanylphthalocyanine crystal after being subjected to a crystal conversion treatment is increased in proportion to the time used for crystal conversion. For the reason, as described above, it is important to enhance the efficiency of crystal conversion and to complete the crystal conversion in a small amount of time. To enhance the efficiency of crystal conversion, there are several important points to follow.

One of the important points is that an appropriate solvent for crystal conversion can be selected to enhance the crystal conversion efficiency. Another point is that in order to complete crystal conversion in a small amount of time, a strong stirring force is used to make the solvent contact with a phthalocyanine water paste (the prepared raw material: indefinitely shaped titanylphthalocyanine) sufficiently. Specifically, conversion of crystal is achieved in a small amount of time by using a stirring unit using fans of an extremely strong stirring force, or a strong stirring (dispersing) unit like homogenizer (Homomixer). Under these conditions, such a crystal conversion can be performed sufficiently without leaving raw materials, and a titanylphthalocyanine crystal in a state where the crystal is not grown any more. In this case, controlling the volume of an organic solvent used for crystal conversion to an appropriate amount is an effective means. Specifically, it is preferable to use an organic solvent in a volume of 30-times or more the solid content of the indefinitely shaped titanylphthalocyanine. By controlling the volume of the organic solvent, it is possible to ensure a conversion of crystal in a small amount of time and to remove impurities contained in an indefinitely shaped titanylphthalocyanine in an assured manner.

In addition, since the relation between the crystal particle size and the crystal conversion time represents a proportional relation, as described above, a method is also an effective means in which upon completion of a predefined reaction (crystal conversion), the crystal conversion is immediately stopped. For example, a method of adding a large amount of solvent which hardly causes an immediate reaction of crystal conversion after completion of crystal conversion is also included in the above noted method. Examples of the solvent which hardly cause an immediate crystal conversion include alcohol solvents and ester solvents. By adding these solvents to the solvent for crystal conversion in a volume at about 30-times the solvent for crystal conversion, the crystal conversion can be stopped.

The smaller the primary particle size of the thus prepared titanylphthalocyanine crystal, the better the results of solution to the problems with photoconductors, however, in consideration of subsequent process in preparation of a pigment (filtration of a pigment) and the dispersion stability of the dispersion liquid for the pigment, crystal particles having an extremely small particle size may cause side-effects. Namely, when the primary particles are extremely fine in size, it may cause a problem that it takes a very long time to filter the particles. Further, when the primary particles are extremely fine, it is highly possible that the particles re-flocculate to each other due to an excessive surface area of pigment particles in the dispersion liquid. Thus, the appropriate particle size of pigment particles is around 0.05 μm to 0.2 μm.

Figure 7:
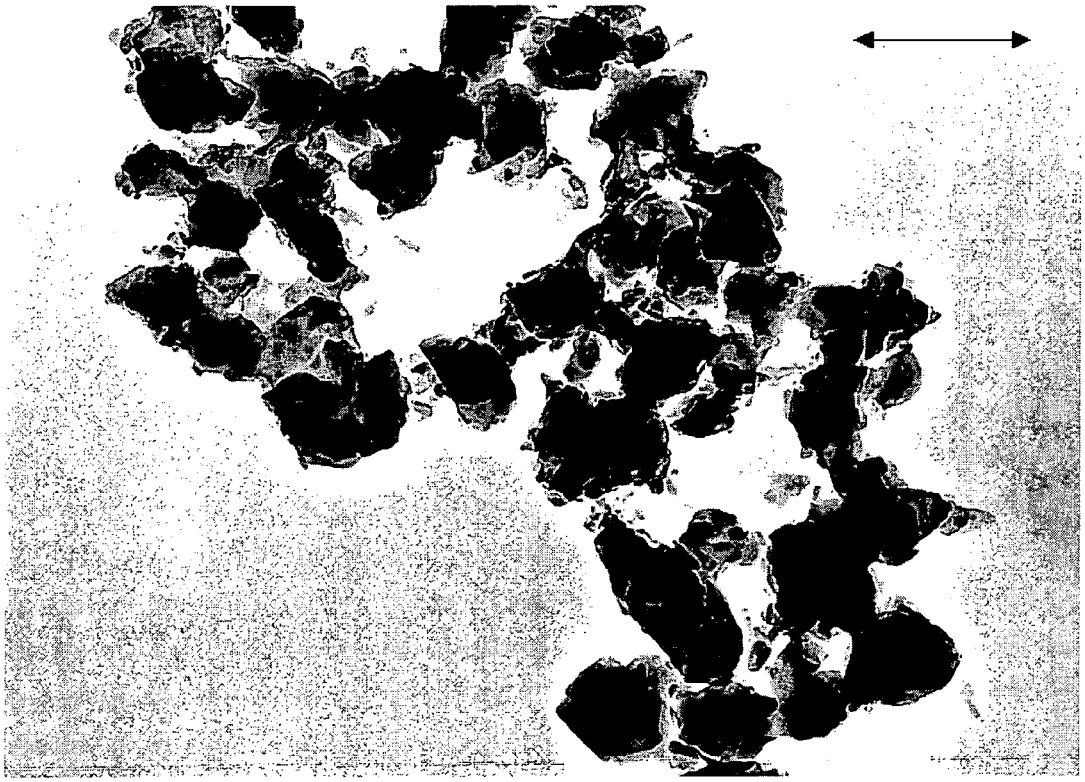
FIG. 7 is a transmission electron microscopic image of titanylphthalocyanine that the crystal was converted in a short time. The scale bar shown in the figure has a length of 0.2 μm.

FIG. 7 is a transmission electron microscopic image of titanylphthalocyanine crystal when the crystal was converted in a short time (the scale bar shown in the figure has a length of 0.2 μm). Unlike the titanylphthalocyanine crystal shown in FIG. 6, the titanylphthalocyanine crystal particles shown in FIG. 7 have a small particle size and are formed almost uniformly, and there are no coarse particles as observed in FIG. 6.

As shown in FIG. 7, when dispersing a titanylphthalocyanine crystal prepared in a state where the primary particles are fine in size, to make the particle size after being subjected to a dispersion treatment (preferably 0.25 μm or less, and more preferably 0.2 μm or less), it is possible to disperse the titanylphthalocyanine crystal by applying a shearing force enough to crush secondary particles which are formed of flocculated primary particles. As the result, because an excessive amount of energy is not applied to the crystal particles, a dispersion liquid having a narrow particle size distribution can be easily prepared without leading to a result that a small proportion of particles are easily transformed to crystal shapes other than a desired crystal shape, as described above.

Here, the volume average particle diameter was determined using a ultracentrifuge automatic particle size distribution measuring device (CAPA-700, available from HORIBA Instruments Inc.) and was calculated as the particle diameter (Median) being equivalent to 50% of the cumulative distribution. However, with this method, there may be cases where a small amount of coarse particles cannot be detected, and thus, to determine the more accurate volume average particle diameter, it is important to directly observe the titanylphthalocyanine crystal powder or the dispersion liquid thereof using an electron microscope to determine the size.

The dispersion liquid was further observed to examine microscopic defects. As the result, the above-noted phenomenon could be understood as follows. Typically, in a method of measuring the average particle size, when extremely large size particles exist at several percent or more, the existence thereof can be detected, however, when extremely large size particles exist at around 1% or less of the entire volume, it falls below the detection limits. As the result, just only a measurement of the average particle size does not allow detecting existence of coarse particles, and it makes it difficult to explain the above-noted microscopic defects.

Figure 8:
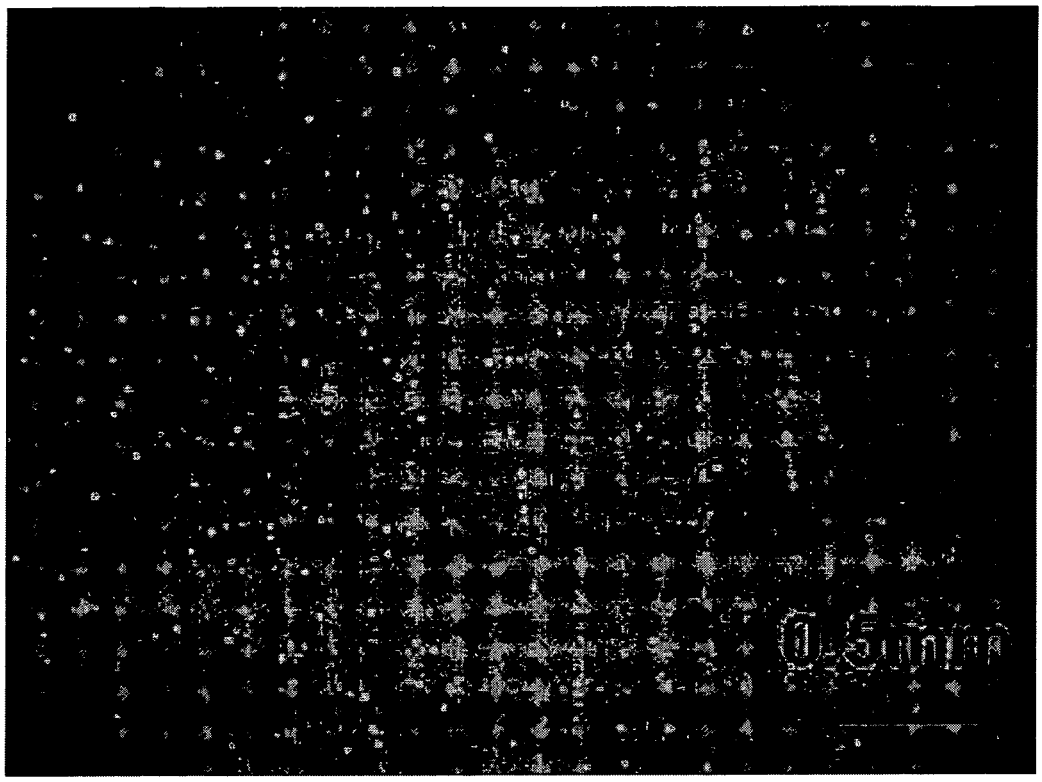
FIG. 8 is a view showing the state of a dispersion liquid prepared under the condition where the dispersion time is short.
Figure 9:
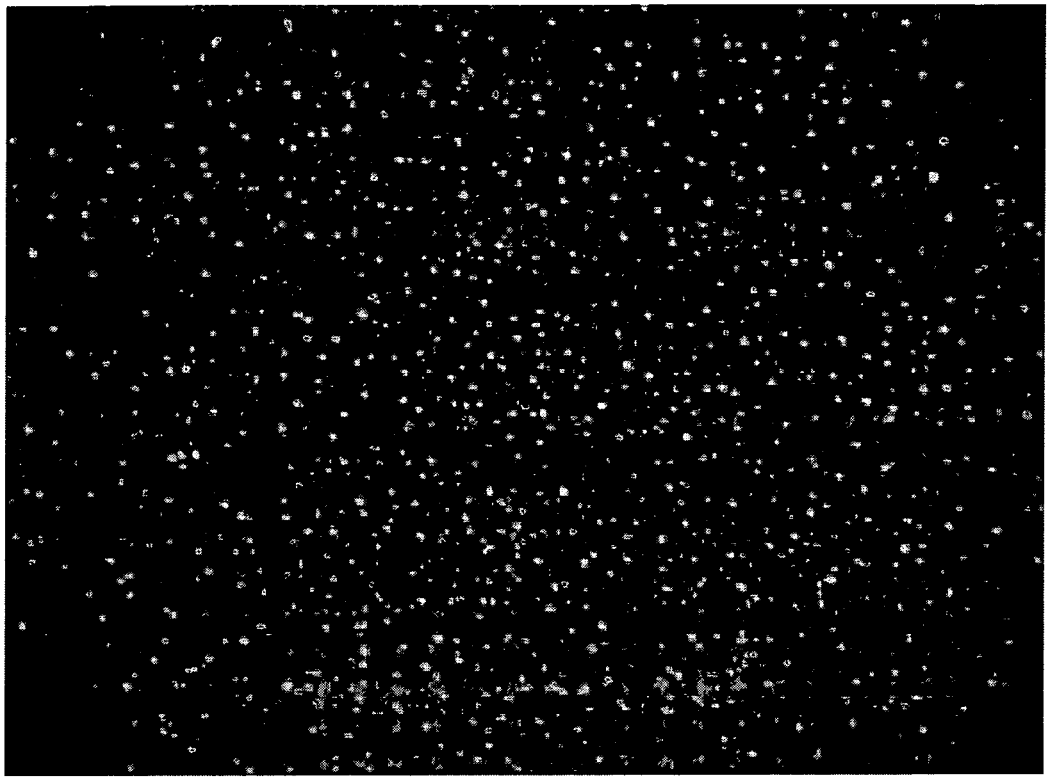
FIG. 9 is a view showing the state of a dispersion liquid under the condition where the dispersion time is long.

FIGS. 8 and 9 respectively show photographs of which two types of dispersion liquids which were prepared under fixed dispersion conditions except that the dispersion time was varied. FIG. 8 is a photograph of a dispersion liquid prepared under the condition of a short dispersion time. It is observed that a much larger amount of coarse particles is left in the photograph of FIG. 8 than in the photograph of FIG. 9 showing a dispersion liquid prepared with long dispersion time. Black particles in FIG. 8 are coarse particles.

Figure 10:
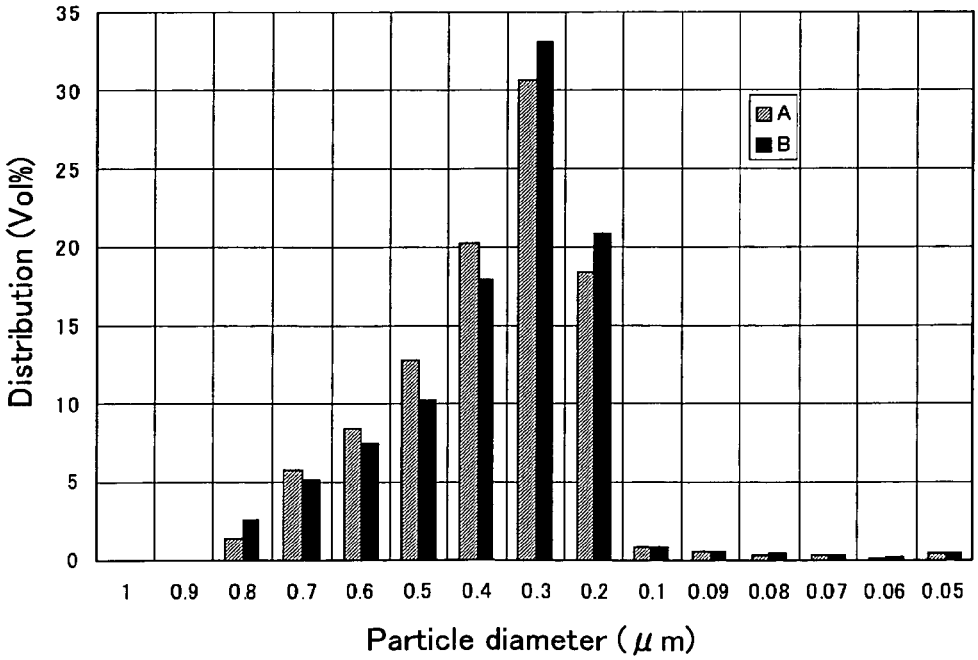
FIG. 10 is a view showing the distribution of the average particle diameter and the particle size on the dispersion liquids of FIGS. 8 and 9, respectively.

The average particle diameter and the particle size distribution of the two dispersion liquids were measured using a particles size distribution measuring device (CAPA700 available from HORIBA Instruments Inc.). FIG. 10 shows the measurement results. "A" shown in FIG. 10 represents the result of the dispersion liquid shown in FIG. 8, and "B" represents the result of the dispersion liquid shown in FIG. 9. When comparing two dispersion liquids, the difference in particle size distribution between the two dispersion liquids can be hardly recognized. The volume average particle diameter of "A" dispersion liquid was calculated as 0.29 μm, and the volume average particle diameter of "B" was calculated as 0.28 μm. In view of measurement deviation, difference therebetween is not recognized at all.

Accordingly, it is understandable that just only defining the volume average particle diameter (average particle size) of particles does not allow detecting existence of a small amount of coarse particles, and present-day high-resolution negative developing and positive developing technique cannot respond to the solution. The existence of a small amount of coarse particles can be recognized only after the coating solution is observed using a microscope.

In view of the above-noted fact, it is effective to make primary particles prepared in a crystal conversion treatment at the smallest possible size. Thus, it is understood that it is an effective means that an appropriate solvent for crystal conversion is selected to enhance the crystal conversion efficiency, and a strong agitation force is used to make the solvent and titanylphthalocyanine water paste (raw materials prepared as described above) sufficiently contact with each other to thereby make the crystal conversion completed in a small amount of time.

By employing such a crystal conversion method, it is possible to obtain a titanylphthalocyanine crystal having a small primary average particle size (the primary particle size is preferably 0.25 μm or less, and more preferably 0.2 μm or less). Using the technique described in JP-A No. 2001-19871 with the above-noted technique (the crystal conversion method to obtain a fine titanylphthalocyanine crystal) in accordance with the necessity is an effective means to improve the effects of the present invention.

By filtering the titanylphthalocyanine crystal that the crystal has been converted immediately after the crystal conversion treatment, a titanylphthalocyanine crystal that has been subjected to a crystal conversion treatment is separated from the solvent for crystal conversion. A filter in appropriate size is used for the filtration, and it is preferable to use a vacuum filter.

Thereafter, the separated titanylphthalocyanine crystal is heated and dried in accordance with the necessity. The drier to be used in heating and drying is not particularly limited, any driers known in the art can be used, however, when the separated titanylphthalocyanine crystal is heated and dried in atmospheric air, a blast drier is preferably used. To accelerate the drying rate and to make the effects of the present invention conspicuously exhibited, drying the titanylphthalocyanine crystal under reduced pressures is also an effective means. The method is very effective for materials that are degraded at high-temperatures or materials of which the crystal shape is changed, and it is more effective to dry the separated titanylphthalocyanine crystal in a condition where the degree of vacuum is higher than 10 mmHg.

The obtained titanylphthalocyanine crystal having a specific crystal shape is extremely useful as a charge generating material, however, as mentioned above, the crystal is disadvantageous in that the crystal shape is in an unstable state, and the crystal shape easily transfers in preparation of the dispersion liquid. Then, by synthesizing a titanylphthalocyanine crystal having the primary particles at the smallest possible size, as can be seen in the present invention, it is possible to prepare a dispersion liquid having a small average particle diameter without giving an extremely strong shearing force to the crystal particles in preparation of the dispersion liquid, and it is also possible to for a titanylphthalocyanine crystal shape in a highly stable manner (without changing the shape of the synthesized crystal).

Next, a method for dispersing the titanylphthalocyanine crystal and removing coarse particles from the titanylphthalocyanine dispersion liquid will be described below.

As for the preparation of the dispersion liquid, a typical method is used The dispersion liquid can be obtained by dispersing the titanylphthalocyanine crystal along with a binder resin in accordance with the necessity in an appropriate solvent using a ball mill, an atlighter, a sand mill, a bead mill, an ultrasonic mill, or the like. In the dispersion, the binder resin may be suitably selected depending on the electrostatic properties of the photoconductor, and the solvent may be suitably selected depending on the wettability to pigments and the dispersibility of the pigments.

As mentioned above, it has been known that titanylphthalocyanine which has a highest diffraction peak, as the Bragg angle 2θ diffraction peak of 0.2 degrees relative to CuKα having a wavelength of 15.42 nm, at least at 27.2 degrees easily transfers into a different crystal shape by stresses of heat energy, mechanical shearing force, and the like. The titanylphthalocyanine crystal has the same tendency. To prepare a dispersion liquid containing fine particles, it is necessary to contrive the dispersion method, however, the stability of the crystal shape and making smaller particle size are represented by a trade-off relation. There are methods to avoid the trade-off relation by optimizing the dispersion conditions, however, any methods extremely narrow the production conditions, and more simple methods are desired.

To solve the problem, the following method is also an effective means.

The method is that a dispersion liquid is prepared in which particles are made to be as fine as possible in a range where no crystal transition occurs, and the dispersion liquid is passed through a filter. With this method, even a small amount of remaining coarse particles that cannot be observed by visual check (or cannot be detected in measurement of particle diameter) can be removed. This is an extremely effective means also from perspective that the particle size distributions are uniformed. Specifically, the prepared dispersion liquid is passed through a filter having an effective pore size of 3 μm or less, more preferably having an effective pore size of 1 μm or less to thereby obtain a dispersion liquid. This method makes it possible to prepare a dispersion liquid containing only a titanylphthalocyanine crystal having a small particle size (the particle size is preferably 0.25 μm or less, and more preferably 0.2 μm or less).

The filter to be used for filtering the dispersion liquid differs depending on the size of coarse particles required to be removed, however, for a latent electrostatic image bearing member (photoconductor) to be used in an image forming apparatus requiring resolution of around 600 dpi, the presence of coarse particles having a particle diameter of at least 3 μm or more affects images to be formed. Thus, it is preferable to use a filter having an effective pore size of 3 μm or less, and it is more preferable to use a filter having an effective pore size of 1 μm or less. By subjecting the dispersion liquid to such a filtration treatment, unnecessary coarse particles can be removed, and a dispersion liquid having a narrow particle size distribution and containing no coarse particles can be prepared.

For the effective pore size of the filter, the smaller, the more effective in removing coarse particles, however, with a filter having an extremely small effective pore size, necessary pigment particles themselves are also passed through the filter, and thus a filter having an appropriate effective pore size is preferable. In addition, when a filter having an extremely small effective pore size is used, it causes problems that it takes long time to filter the dispersion liquid, the filter is clogged, and it is overloaded when the dispersion liquid is sent through to the filter using a pump, etc. For the material of the filter used here, the one that is resistant to a solvent used in the dispersion liquid to be filtered is preferably used.

In the filtration, when the amount of coarse particles in the dispersion liquid to be filtered is extremely large, it is unfavorable because a large amount of pigment particles are removed, and then the solid content concentration of the filtered dispersion liquid varies. Thus, when the dispersion liquid is filtered, there is an appropriate particle size distribution (particle size, and standard deviation). To efficiently filter the dispersion liquid without causing loss of pigment particles attributable to filtration and clogged filter, or the like, it is preferred to make the dispersion liquid dispersed such that the volume average particle diameter of the pre-filtered dispersion liquid is 0.3 μm or less, and the standard deviation is 0.2 μm or less.

By adding such a filtration treatment of the dispersion liquid, it is also possible to remove coarse particles. As the result, the amount of background smear caused by a latent electrostatic image bearing member (photoconductor) utilizing a dispersion liquid can be reduced. As mentioned above, the smaller the filter is used, the greater the effect becomes, however, there may be cases where pigment particles themselves are erroneously filtered. In such a case, using a filter having a small pore size in a filtration treatment in combination with the above-noted technique in which primary particles of titanylphthalocyanine are made to be small in size and then synthesized brings about an extremely large effect.

In other words, (i) by synthesizing finely sized titanylphthalocyanine and using the synthesized titanylphthalocyanine, the dispersion time can be shortened, the stress of the dispersion can be reduced, and the possibility of occurrences of crystal transition in a dispersion treatment can be reduced. (ii) Because the size of residual coarse particles cause by a dispersion treatment is smaller than that in the case where the particles are not made small in size, a smaller filter can be used, and the removing effect of coarse particles is more assured. In addition, the amount of the titanylphthalocyanine particles to be removed is reduced, and thus it is possible to prepare a dispersion liquid in a stable condition without causing a change of the composition of the dispersion liquid before and after a filtration treatment. (iii) As the result, a produced photoconductor has high resistance to background smear.

The charge generating layer can be formed by dispersing the charge generating materials along with a binder resin in accordance with the necessity in a solvent using a ball mill, an atlighter, a sand mill, an ultrasonic mill, or the like, applying the dispersion liquid over a surface of the conductive support, and drying the photoconductive support surface.

For materials of the charge generating layer, a binder resin can be added in accordance with the necessity. The binder resin is not particularly limited, may be suitably selected in accordance with the intended use, and examples thereof include polyamide resins, polyurethane resins, epoxy resins, polyketone resins, polycarbonate resins, silicone resins, acrylic resins, polyvinyl butyral resins, polyvinyl formal resins, polyvinylketones reins, polystyrene resins, polysulfone resins, poly-N-vinylcarbazole resins, polyacrylamide resins, polyvinylbenzal resins, polyester reins, phenoxy resins, vinylchloride-vinylacetate copolymers, polyvinyl acetate resins, polyphenylene oxide resins, polyvinyl pyridine resins, cellulose resins, caseins, polyvinyl alcohol resins, and polyvinyl pyrolidone resins.

The content of the binder resin is not particularly limited and may be suitably adjusted in accordance with the intended use, however, it is preferably 0 parts by mass to 500 parts by mass, and more preferably 10 parts by mass to 300 parts by mass relative to 100 parts by mass of the charge generating materials.

The solvent is not particularly limited, may be suitably selected in accordance with the intended use, and examples thereof include isopropanols, acetones, methylethylketones, cyclohexanons, tetrahydrofurans, dioxanes, toluenes, xylenes, and ligroins. Each of these solvents may be used alone or in combination with two or more.

The method of applying the coating solution of the charge generating layer is not particularly limited, may be suitably selected in accordance with the intended use, however, examples thereof include immersion coating method, spray coating method, beat coating method, nozzle coating method, spinner coating method, and ring coating method.

The thickness of the charge generating layer is not particularly limited and may be suitably selected in accordance with the intended use, however, it is preferably 0.01 μm to 5 μm, and more preferably 0.1 μm to 2 μm.

(Method for Producing Latent Electrostatic Image Bearing Member)

The method for producing a latent electrostatic image bearing member of the present invention includes at least a charge transporting layer forming step and a surface treatment step, and further includes other steps in accordance with the necessity.

—Formation of Charge Transporting Layer—

The charge transporting layer forming step is a step in which a coating solution for charge transporting layer containing at least a charge transporting material, a binder resin, and non-halogen solvent is applied over a surface of a charge generating layer, and the surface of the charge generating layer with the coating solution for charge transporting layer applied thereon is dried to thereby form a charge transporting layer.

Even when a charge transporting layer having a thickness of 30 μm or more using a non-halogen solvent, like this, the repetitive durability can be improved.

By using the non-halogen solvent, it is possible to reduce the environmental burden and to make excellent charge properties exhibited. For the non-halogen solvent, cyclic ethers such as tetrahydrofuran, dioxolan, and dioxane; aromatic hydrocarbons such as toluene, and xylene, or derivatives thereof can be preferably used.

For the charge transporting materials and the binder reins, those described above can be used.

The method of applying the coating solution of charge transporting layer is not particularly limited, may be suitably selected in accordance the intended use, and examples thereof include immersion coating method, spray coating method, beat coating method, nozzle coating method, spinner coating method, and ring coating method.

—Surface Treatment Step—

The surface treatment step is a step in which the formed charge transporting layer is subjected to a surface treatment selected from heat treatment, UV irradiation treatment, electron beam irradiation treatment, and corona discharge treatment. Among these surface treatments, heat treatment and corona discharge treatment are preferably used for its small amount of degradation influence upon the photoconductor materials. The conditions used in the heating treatment are not particularly limited and may be suitably selected in accordance with the intended use, provided that no inflection point is held under the conditions, however, it is preferred that the formed charge transporting layer is left under the temperature environment of 80° C. to 150° C. for 1 hour to 50 hours.

The conditions used in the corona discharge treatment are not particularly limited and may be suitably selected in accordance with the intended use, however, it is preferable to leave. the surface of the photoconductor at a voltage of 500 (−V) to 2,000 (−V) for 20 hours to 200 hours to thereby subject the photoconductor surface to a surface treatment.

For the conditions for the UV irradiation treatment, for example, a high-pressure mercury lamp or a metal halide lamp can be used as the light source for irradiation, and it is preferable to apply a UV ray with an exposure dose of 50 $mW/cm^2$ to 2,000 $mW/cm^2$.

For the conditions used in the electron beam irradiation treatment, for example, a high-energy or a low-energy electron beam irradiation device can be used, however, a low-energy electron beam irradiation device is particularly preferable to avoid degradation influence upon the photoconductive materials, and the low-energy electron beam irradiation device is preferably used at an exposure dose of 100 kGy or less.

Examples of the other steps include a charge generating layer forming step, a charge blocking layer forming step, and a moiré layer forming step.

According to the method for producing a latent electrostatic image bearing member of the present invention, as shown in the distribution in FIG. 4, by satisfying the conditions that the distribution representing the relation between the absorbance ratio of the charge transporting material and the binder resin measured by infrared spectroscopy shows a generally linear shape without having inflection points within 20 μm from the surface of the charge transporting layer toward the thickness thereof (the square of a correlation coefficient between the absorbance ratio and the distance from the surface of the charge transporting layer toward the thickness thereof is 0.92 or more), or the absorbance ratio B between the charge transporting material and the binder resin at 5 μm inside of the surface of the charge transporting layer represents B/A=1.0 to 1.15, it is possible to obtain a latent electrostatic image bearing member which hardly cause background smear and toner filming, has less amount of environmental burden because of the use a non-halogen solvent, and excels in durability as well as to suitably use in image forming based on various xerographic (electrophotographic) techniques known in the art, and the latent electrostatic image bearing member can be particularly preferably used in the image forming apparatus and the image forming method of the present invention which will be described hereinafter.

(Image Forming Method and Image Forming Apparatus)

The image forming method of the present invention includes at least a latent electrostatic image forming step, a developing step, a transferring step, and a fixing step and further includes other steps suitably selected in accordance with the necessity such as a charge elimination step, a recycling step, and a controlling step.

The image forming apparatus of the present invention is provided with at least a latent electrostatic image bearing member, a latent electrostatic image forming unit, a developing unit, a transferring unit and a fixing unit, is preferably provided with a cleaning step, and is further provided with other units suitably selected in accordance with the necessity such as a charge elimination unit, a recycling unit, and a controlling unit.

The image forming method of the present invention can be preferably carried out by means of the image forming apparatus of the present invention, the formation of a latent electrostatic image can be carried out by means of the latent electrostatic image forming unit, the developing can be carried out by means of the developing unit, the transferring can be carried out by means of the transferring unit, the fixing can be carried out by means of the fixing unit, and the other steps can be carried out by means of the other units.

The latent electrostatic image forming step is a step in which a latent electrostatic image is formed on a latent electrostatic image bearing member.

For the latent electrostatic image bearing member, the latent electrostatic image bearing member of the present invention can be suitably used.

The latent electrostatic image can be formed, for example, by charging the surface of the latent electrostatic image bearing member uniformly and then exposing the surface thereof imagewisely by means of the latent electrostatic image forming unit. The latent electrostatic image forming unit is provided with, for example, at least a charger configured to uniformly charge the surface of the latent electrostatic image bearing member, and an exposer configured to expose the surface of the latent electrostatic image bearing member imagewisely.

The surface of the latent electrostatic image bearing member can be charged by applying a voltage to the surface of the latent electrostatic image bearing member through the use of, for example, the charger.

The charger is not particularly limited, may be suitably selected in accordance with the intended use, and examples thereof include contact chargers known in the art, for example, which are equipped with a conductive or semi-conductive roller, a brush, a film, a rubber blade or the like, and non-contact chargers utilizing corona discharge such as corotoron and scorotoron.

The surface of the latent electrostatic image bearing member can be exposed, for example, by exposing the surface of the latent electrostatic image bearing member imagewisely using the exposer.

The exposer is not particularly limited, provided that the surface of the latent electrostatic image bearing member which has been charged by the charger can be exposed imagewisely, may be suitably selected in accordance with the intended use, and examples thereof include various types of exposers such as reproducing optical systems, rod lens array systems, laser optical systems, and liquid crystal shutter optical systems.

In the present invention, the back light method may be employed in which exposing is performed imagewisely from the back side of the latent electrostatic image bearing member.

<Developing and Developing Unit>

The developing step is a step in which the latent electrostatic image is developed using a toner or a developer to form a visible image.

The visible image can be formed by developing the latent electrostatic image using, for example, a toner or a developer by means of the developing unit.

The developing unit is not particularly limited and may be suitably selected from those known in the art, as long as a latent electrostatic image can be developed using a toner or a developer. Preferred examples thereof include the one having at least an image developing device which houses a toner or a developer therein and enables supplying the toner or the developer to the latent electrostatic image in a contact or a non-contact state, and an image developing device provided with a toner container is more preferable.

The image developing device may employ a dry-developing process or a wet-developing process. It may be a monochrome color image developing device or a multi-color image developing device. Preferred examples thereof include the one having a stirrer by which the developer is frictionally stirred to be charged, and a rotatable magnet roller.

In the image developing device, for example, a toner and the carrier are mixed and stirred, the toner is charged by frictional force at that time to be held in a state where the toner is standing on the surface of the rotating magnet roller to thereby form a magnetic brush. Since the magnet roller is located near the latent electrostatic image bearing member, a part of the toner constituting the magnetic brush formed on the surface of the magnet roller moves to the surface of the latent electrostatic image bearing member by electric attraction force. As the result, the latent electrostatic image is developed using the toner to form a visible toner image on the surface of the latent electrostatic image bearing member.

The developer to be housed in the image developing device is a developer containing a toner, and the developer may be a one component developer or may be a two-component developer.

<Transferring and Transferring Unit>

In the transferring step, the visible image is transferred onto a recording medium, and it is preferably an embodiment in which an intermediate transfer member is used, the visible image is primarily transferred to the intermediate transfer member and then the visible image is secondarily transferred onto the recording medium. An embodiment of the transferring step is more preferable in which two or more color toners are used, an embodiment of the transferring is still more preferably in which a full-color toner is used, and the embodiment includes a primary transferring in which the visible image is transferred to an intermediate transfer member to form a composite transfer image thereon, and a secondary transferring in which the composite transfer image is transferred onto a recording medium.

The transferring can be performed, for example, by charging a visible image formed on the surface of the latent electrostatic image bearing member using a transfer-charger to transfer the visible image, and this is enabled by means of the transferring unit. For the transferring unit, it is preferably an embodiment which includes a primary transferring unit configured to transfer the visible image to an intermediate transfer member to form a composite transfer image, and a secondary transferring unit configured to transfer the composite transfer image onto a recording medium.

The intermediate transfer member is not particularly limited, may be suitably selected from among those known in the art in accordance with the intended use, and preferred examples thereof include transferring belts.

The transferring unit (the primary transferring unit and the secondary transferring unit) preferably includes at least an image-transferer configured to exfoliate and charge the visible image formed on the latent electrostatic image bearing member to transfer the visible image onto the recording medium. For the transferring unit, there may be one transferring unit or two or more transferring units.

Examples of the image transferer include corona image transferers using corona discharge, transferring belts, transfer rollers, pressure transfer rollers, and adhesion image transfer units.

The recording medium is not particularly limited and may be suitably selected from among those known in the art.

<Fixing and Fixing Unit>

The fixing step is a step in which a visible image which has been transferred onto a recording medium is fixed using a fixing apparatus, and the image fixing may be performed every time each color toner is transferred onto the recording medium or at a time so that each of individual color toners are superimposed at the same time.

The fixing apparatus is not particularly limited, may be suitably selected in accordance with the intended use, and heat-pressurizing units known in the art are preferably used. Examples of the heat-pressurizing units include a combination of a heat roller and a pressurizing roller, and a combination of a heat roller, a pressurizing roller, and an endless belt.

The heating temperature in the heat-pressurizing unit is preferably 80° C. to 200° C.

In the present invention, for example, an optical fixing apparatus known in the art may be used in the fixing step and the fixing unit, or instead of the fixing unit.

<Charge Elimination and Charge Elimination Unit>

The charge elimination step is a step in which charge is eliminated by applying a charge-eliminating bias to the latent electrostatic image bearing member, and it can be suitably performed by means of a charge-eliminating unit.

The charge-eliminating unit is not particularly limited as long as a charge-eliminating bias can be applied to the latent electrostatic image bearing member, and may be suitably selected from among charge-eliminating units known in the art. For example, a charge-eliminating lamp or the like is preferably used.

<Cleaning and Cleaning Unit>

The cleaning step is a step in which a residual electrographic toner remaining on the latent electrostatic image bearing member is removed, and the cleaning can be preferably performed using a cleaning unit.

The cleaning unit is not particularly limited, provided that the residual electrophotographic toner remaining on the latent electrostatic image bearing member can be removed, and may be suitably selected from among those known in the art. Examples of the cleaning unit include magnetic brush cleaners, electrostatic brush cleaners, magnetic roller cleaners, blade cleaners, brush cleaners, and web cleaners.

In the present invention, as the cleaning unit, it is preferable to use a cleaning unit having at least a brush rotator which is configured to rotate in the same direction ad the movement of the latent electrostatic image bearing member at a contact point between the brush rotator and the latent electrostatic image bearing member.

<Recycling and Recycling Unit>

The recycling step is a step in which the toner that had been eliminated in the cleaning is recycled in the developing, and the recycling can be suitably performed by means of a recycling unit.

The recycling unit is not particularly limited, and examples thereof include carrying units known in the art.

<Controlling and Controlling Unit>

The controlling step is a step in which each of the above-noted steps are controlled, and the each of these steps can be preferably controlled by using a controlling unit.

The controlling unit is not particularly limited and may be suitably selected in accordance with the intended use as long as operations of each of the above-noted units can be controlled, and examples thereof include equipment such as sequencers and computers.

One embodiment of performing the image forming method of the present invention using the image forming apparatus of the present invention will be described below referring to drawings.

Figure 11:
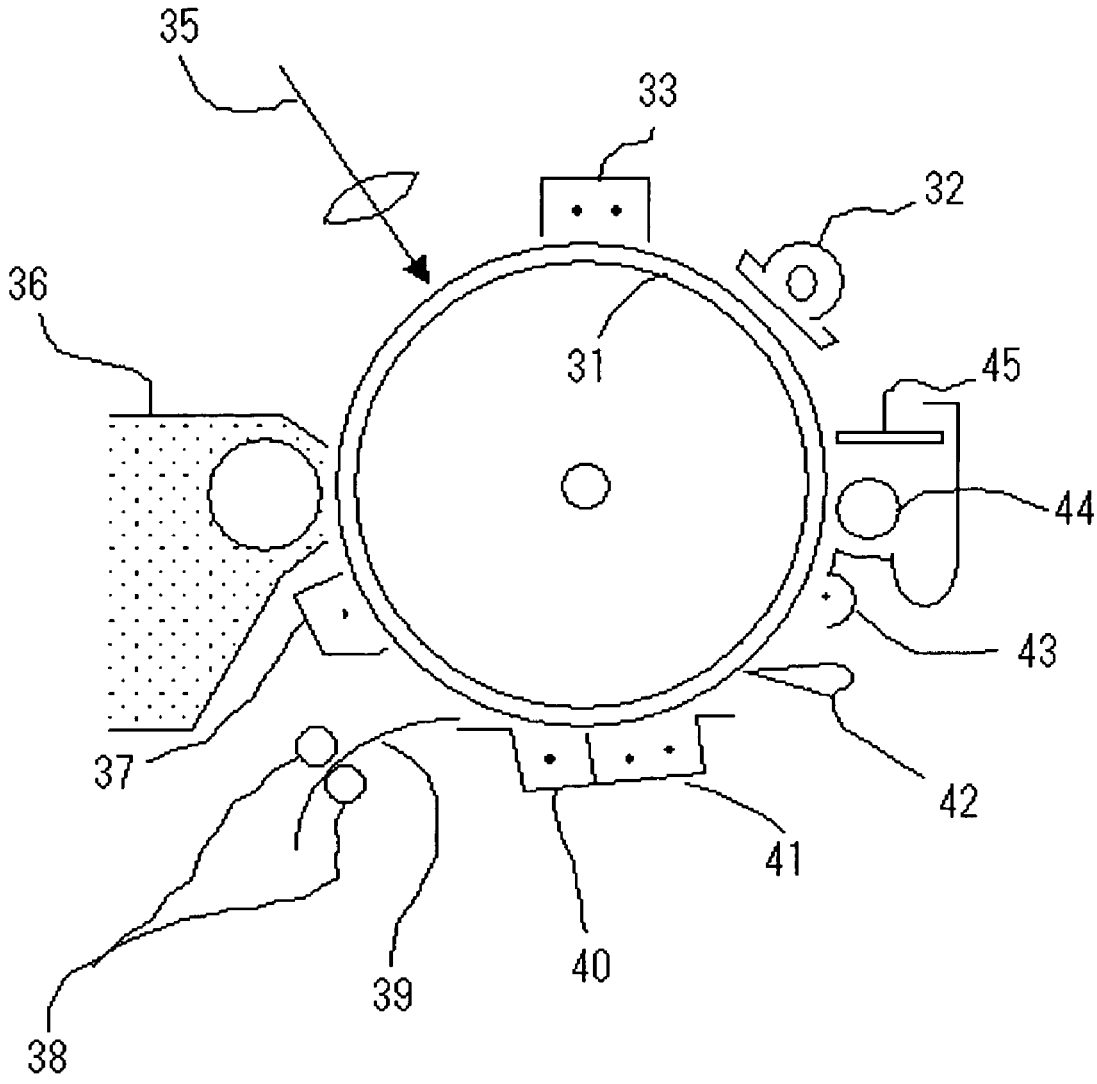
FIG. 11 is a schematic view for illustrating the electrophotographic process and the image forming apparatus of the present invention.

FIG. 11 is a schematic view for illustrating the image forming method (the electrophotographic process) and the image forming apparatus of the present invention. In FIG. 11, a latent electrostatic image bearing member (photoconductor) 31 is formed in a drum shape, however it may be formed in a sheet or an endless belt. For an electric charger 33, a pre-transfer charger 37, a transfer charger 40, a separation charger 41, and a pre-cleaning charger 43, chargers known in the art typified by corotoron, scorotoron, solid state chargers, charge rollers, and transfer rollers can be used.

Among these charge systems, contact charge systems or closely arrayed non-contact charge systems are particularly preferable, and contact charge systems or closely arrayed non-contact charge systems are advantageous in that they have high charge efficiency, have less ozone yield, and allows smaller sizing of apparatuses.

For the light source of an exposer 35 and a charge eliminating lamp 32 or the like in an image exposing unit, it is possible to use light-emitters in general such as fluorescent lamps, tungsten lamps, halogen lamps, mercury lamps, sodium lamps, light-emitting diodes (LED), semiconductor lasers (LD), and electro luminescence (EL).

To apply only a light having a desired wavelength region on the surface of the latent electrostatic image bearing member, it is possible to use various filters such as sharp cut filters, band pass filters, near-infrared cut filters, dichroic filters, interference filters, and conversion filters for color temperature.

Among these light sources, light-emitting diodes, and semiconductor lasers are favorably used because these light sources have high-exposure energy (dose) and have light having wavelengths of 600 nm to 800 nm, and thus phthalocyanine pigments used as the charge generating material exhibit high-sensitivity.

Light from the light source is applied onto the surface of the photoconductor by providing with a transferring step using another light irradiation, a charge eliminating step, a cleaning step, or a pre-exposing step, besides the steps shown in FIG. 11. The toner developed on the surface of the photoconductor 31 by means of the developing unit 36 is transferred onto a transferring sheet 39, however, all the toner used for the developing is not transferred onto the transferring sheet, and a part of toner remains on the surface of the photoconductor 31. Such a residual toner is eliminated from the surface of the photoconductor 31 by means of a fur brush 44, and a cleaning blade 45. The cleaning may be performed using a cleaning brush only, and for the cleaning brush, those known in the art typified by fur brushes and magfur brushes are used.

In the present invention, it is more preferable that the image forming apparatus has a brush rotator, and the brush rotator rotates in the same direction of the rotational direction of the latent electrostatic image bearing member (photoconductor) at a contact point with the photoconductor (in FIG. 11, the photoconductor rotates in anticlockwise direction, and the cleaning brush rotates in clockwise direction). When a cleaning brush rotates in the same direction as the rotational direction of a photoconductor at a contact point between the cleaning brush and the photoconductor, the photoconductor rarely has flaws, and it hardly cause fixing of toner components to the surface of photoconductor, which is caused from insufficient toner-scratching ability, and thus it is possible to obtain an image forming apparatus which is more excellent in durability.

When a positive or negative charge is applied on the surface of the electrophotographic photoconductor 31 to expose the surface thereof imagewisely, a positive or negative latent electrostatic image is formed on the surface of the photoconductor 31. When the positive or negative latent electrostatic image is developed using a negative polar toner (a voltage detecting particulate), a positive image can be obtained. When the positive or negative latent electrostatic image is developed using a positive polar toner, a negative image can be obtained.

For the above-noted developing unit 36, a known method can be used. For the charge eliminating unit, a known method can be used.

Next, image forming components which include the latent electrostatic image bearing member (electrophotographic photoconductor) of the present invention will be described.

The image forming elements contains a latent electrostatic image bearing member, and are structured as a unit in which at least a charging member, a developing member, and a cleaning member are arrayed around the latent electrostatic image bearing member, and in the case of a color electrophotographic image forming apparatus in which a plurality of colors are used, image forming elements according to the number of colors are equipped in the image forming apparatus. Each of the image forming elements may be fixed to the image forming apparatus or may be individually replaced for use.

Figure 12:
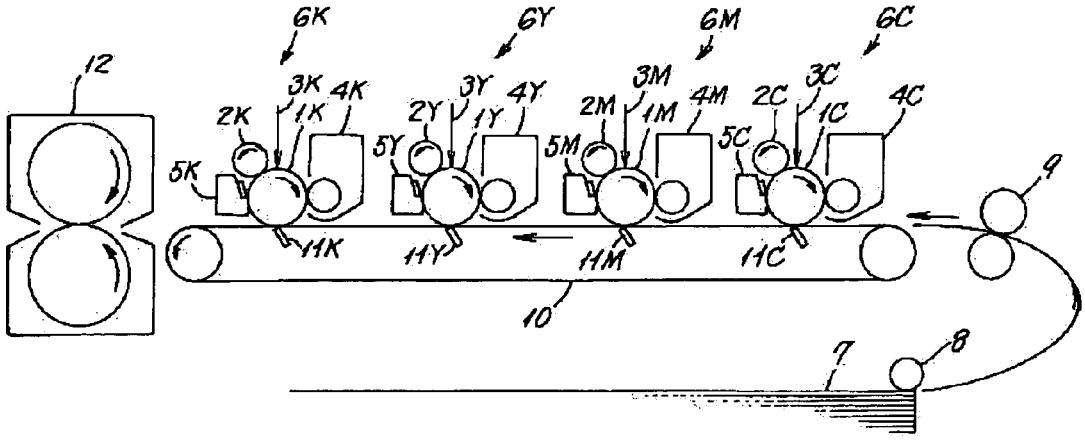
FIG. 12 is a schematic view for illustrating a tandem full color image forming apparatus of the present invention.

FIG. 12 is a schematic view for illustrating an image forming apparatus equipped with a plurality of image forming elements (generally, called as tandem full-color image forming apparatus).

In FIG. 12, reference numerals 1C, 1M, 1Y, and 1K respectively represent a drum-like photoconductor, and the photoconductors 1C, 1M, 1Y, and 1K respectively rotate in the direction indicated by arrows in FIG. 12. Around the photoconductors 1C, 1M, 1Y, and 1K, at least charging members 2C, 2M, 2Y, and 2K; developing members 4C, 4M, 4Y, and 4K; and cleaning members 5C, 5M, 5Y, and 5K are arranged in the rotation order. The charging members 2C, 2M, 2Y, and 2K are chargers for uniformly charging the respective surfaces of photoconductors.

From the backside of the photoconductor between the charging members 2C, 2M, 2Y, and 2K and the developing members 4C, 4M, 4Y, and 4K, laser beams 3C, 3M, 3Y, and 3K from exposing members (not shown) are applied on the respective surfaces of the photoconductors 1C, 1M, 1Y, and 1K to thereby form a latent electrostatic image on the photoconductors 1C, 1M, 1Y, and 1K. Four image forming elements 6C, 6M, 6Y, and 6K centering on the photoconductors 1C, 1M, 1Y, and 1K are aligned along a transfer carrying belt 10 serving as a transfer carrying unit. The transfer carrying belt 10 is arranged between the developing members 4C, 4M, 4Y, and 4K and the cleaning members 5C, 5M, 5Y, and 5K in each of the image forming units 6C, 6M, 6Y, and 6K so as to make contact with the respective photoconductors 1C, 1M, 1Y, and 1K, and transfer brushes 11C, 11M, 11Y, and 11K for applying a transfer bias are arranged on the backside surfaces of the photoconductors 1C, 1M, 1Y, and 1K with which the transfer carrying belt comes into contact. The each of the image forming elements 6C, 6M, 6Y, and 6K has a different color toner which is housed inside the respective image developing devices, and has the same configurations except for the different color toners.

In a color electrophotographic image forming apparatus having configurations shown in FIG. 12, image forming operations are performed as follows. First, in each of the image forming elements 6C, 6M, 6Y, and 6K, the photoconductors 1C, 1M, 1Y, and 1K are charged by means of the charging members 2C, 2M, 2Y, and 2K which respectively rotate in the direction indicated by arrows (2C, 2M, 2Y, and 2K respectively rotate along with the rotational direction of the respective photoconductors 1C, 1M, 1Y, and 1K). Next, latent electrostatic images each corresponding to each color image to be produced are formed by action of the laser beams 3C, 3M, 3Y, and 3K emitted from exposing units (not shown) arranged inside the respective photoconductors 1C, 1M, 1Y, and 1K.

Next, the latent electrostatic images are developed by action of the developing members 4C, 4M, 4Y, and 4K to form visible images (toner images). The developing members 4C, 4M, 4Y, and 4K are image developing devices for developing images using C (Cyan), M (Magenta), Y (Yellow), and K (Black) toners respectively, and each color visible images (toner images) formed on the four photoconductors 1C, 1M, 1Y, and 1K are superimposed on a transferring sheet 7.

The transferring sheet 7 is fed from a tray by action of a paper feed roller 8. It once stops by a pair of resist rollers 9 and then conveyed to the transfer carrying belt 10 in timing with the image formation on the photoconductors. The transferring sheet 7 held on the transfer carrying belt 10 is then transported and at a contact position (transfer portion) with the photoconductors 1C, 1M, 1Y, and 1K, the toner image of each color is transferred. The toner image on each photoconductor is transferred onto the transferring sheet 7 by an electric field derived from a difference in the potential between the transfer bias applied to the transferring brushes 11C, 11M, 11Y, 11K and the photoconductors 1C, 1M, 1Y and 1K. The transferring sheet 7 having passed through the four transfer regions and having the toner images of the four colors overlaid thereon is conveyed to a fixing device 12 at which the toner is fixed and then the transferring sheet 7 is ejected to a paper ejecting section (not shown). The toner remaining on the photoconductors 1C, 1M, 1Y, and 1K without being transferred onto the transfer regions is collected by cleaners 5C, 5M, 5Y, and 5K, respectively. In the example illustrated in FIG. 12, the colors of the image forming elements are, from the upstream side toward the downstream side of the transferring sheet conveying direction, cyan (C), magenta (M), yellow (Y) and black (K). The order of the colors is not limited thereto but can be set as desired.

When a manuscript is made only in black color, it is particularly effective in the present invention to install a mechanism capable of terminating the image forming elements 6C, 6M, and 6Y other than black color. In FIG. 12, the charging member is in contact with the photoconductor. By disposing a suitable gap (about 10 μm to 200 μm) between the charging member and photoconductor, the abrasion amount therebetween can be reduced and toner filming on the charger member can be reduced. Thus, such a charging mechanism is preferably employed.

The image forming elements as described above can be incorporated into an electrophotographic image forming apparatus such as a copier, a facsimile or a printer while being fixed thereto, and each of the image forming elements may be incorporated into such an apparatus as a process cartridge so as to be detachably mounted thereon.

The process cartridge does not mean the image forming elements used for a full-color electrophotographic image forming apparatus, however, a process cartridge having such a structure that it can be detachably mounted on a monochrome color image forming apparatus for image forming with only one-color, incorporating the latent electrostatic image bearing member (electrophotographic photoconductor) of the present invention, and being further equipped with at least one selected from a charging unit, a developing unit, a transferring unit, a cleaning unit, and a charge eliminating unit is also included into the scope of the present invention. It should be noted that among the image forming units, each of those not to be mounted to a process cartridge is to be mounted to an image forming apparatus.

Figure 13:
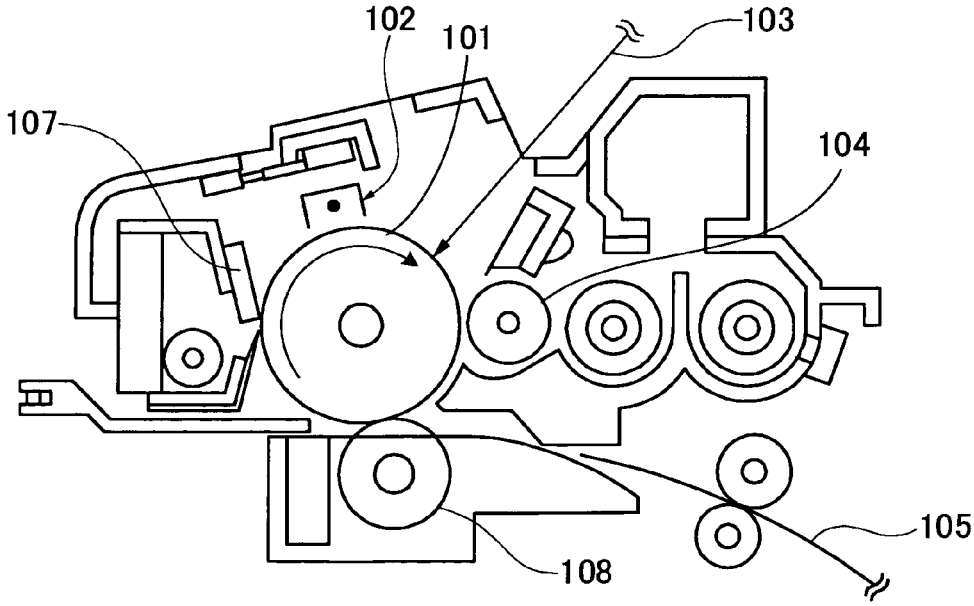
FIG. 13 is a schematic view showing one example of the process cartridge of the present invention.

Here, the process cartridge incorporates, as shown in FIG. 13, a photoconductor 10, and is equipped with at least one selected from a charging unit 102, a developing unit 104, a transferring unit 108, a cleaning unit 107, and a charge eliminating unit (not shown), and can be detachably mounted on an apparatus.

According to the image forming process using the process cartridge shown in FIG. 13, on the surface of a photoconductor 101, a latent electrostatic image corresponding to an exposed image is formed by charging using a charging unit 102 and exposure 103 using an exposing unit while the photoconductor rotating in the direction indicated by the arrow in the figure. The latent electrostatic image is developed by means of a developing a developing unit 104 to form a toner image, the toner image is transferred onto a recording medium 105 by means of a transferring unit 108 to be printed out. Next, the surface of the photoconductor 101 after transferring the image is cleaned by means of a cleaning unit 107, and further charge-eliminated by means of a charge eliminating unit (not shown), and then the above-noted operations are repeatedly performed.

The image forming apparatus of the present invention may be structured to integrate the latent electrostatic image bearing member, and components such as an image developing device, and a cleaning unit with a process cartridge in to a unit, and the unit may be structured to be detachably mounted to the body of an image forming apparatus. At least one selected from a charger, an exposer, an image developing device, a transferer or a separator, and a cleaner is integrated along with a photoconductor into a unit to form a process cartridge, and the process cartridge may be made to be a single unit that can be detachably mounted on a body of an image forming apparatus using a guiding unit such as rails attached on the body of the image forming apparatus.

With the use of the image forming apparatus, the image forming method, and the process cartridge of the present invention, highly fine and high-quality images can be formed over a long period of time without causing abnormal images such as background smear and toner filming because the latent electrostatic image bearing member of the present invention is used which excels in abrasion resistance and stability of image quality and enables stably outputting high-quality images over a long period of time.

EXAMPLES

Hereafter, the present invention will be further described in detail referring to specific examples, however, the present invention is not limited to the disclosed examples. In the examples, "part" or "parts" represents "part by mass" or "parts by mass", and "%" represents "% by mass".

Synthesis Example 1

—Synthesis of Pigment 1—

A pigment was prepared according to the method described in Japanese Patent Application Laid Open (JP-A) No. 2001-19871. First, 29.2 g of 1,3-diiminoisoindline and 200 mL of sulfolane were mixed, and 20.4 g of titanium tetrabutoxide was delivered by drops into the mixture under nitrogen gas stream. Upon completion of the dropping, the temperature of the mixture was gradually raised to 180° C., and a reaction was performed by stirring the mixture for 5 hours while keeping the reaction temperature between 170° C. and 180° C. After the reaction, the mixture was left intact to be cooled, and the mixture was filtered to obtain a precipitate, and the precipitate was washed with chloroform until the powder turned blue. Next, the powder was washed with methanol several times, and washed with hot water of 80° C. several times and then dried to yield a coarse titanylphthalocyanine. The obtained coarse titanylphthalocyanine was dissolved in a dense sulfuric acid of 20 times in volume as much as the titanylphthalocyanine, and the dissolved material was delivered by drops into ice water of 100 times in volume as that of the dissolved material with stirring to precipitate a crystal. The crystal was then filtered. Next, the filtered crystal was repeatedly washed with water until the cleaning fluid was neutral (the pH value of the ion exchange water after being washed was 6.8) to thereby yield a wet cake (water paste) of a titanylphthalocyanine pigment. Then, 40 g of the obtained wet cake (water paste) was put in 200 g of tetrahydrofuran, and the mixture was stirred for 4 hours. The mixture was filtered and dried to thereby prepare a titanylphthalocyanine powder. This was taken as "pigment 1".

The solid content concentration of the obtained wet cake was 15%. The mass ratio of the solvent used for crystal conversion relative to the wet cake was 33:1. It should be noted that no halogenated material was used for the raw material of the pigment 1 of Synthesis Example 1.

Figure 14:
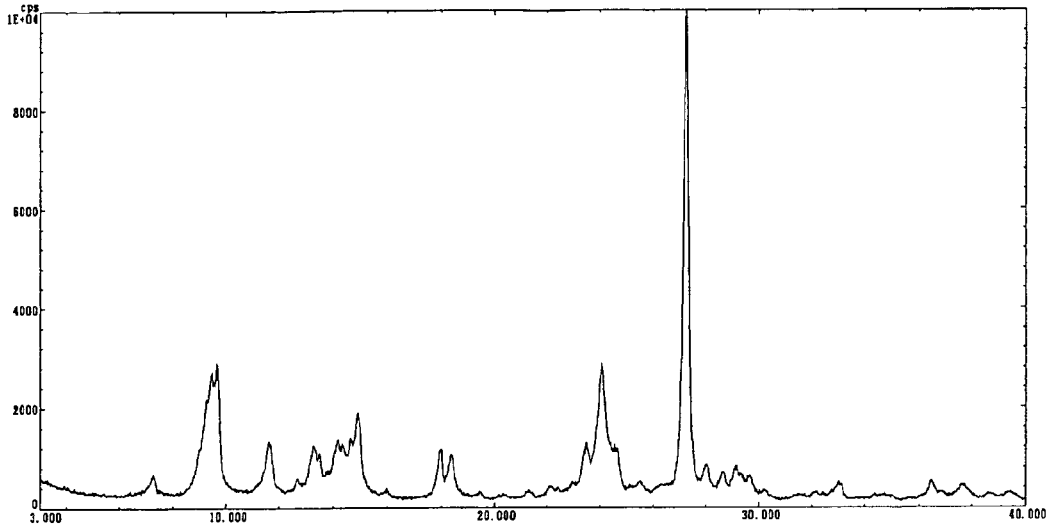
FIG. 14 is a view showing the XD spectrum of titanylphthalocyanine obtained in Synthesis Example 1.

The obtained titanylphthalocyanine powder was measured by an X-ray diffraction spectrum under the following conditions. As the result, it was found that it was possible to obtain a titanylphthalocyanine powder having a highest diffraction peak, as the Bragg angle 2θ diffraction peak relative to characteristic X-rays of CuKα having a wavelength of 15.42 nm, at least at 27.2 degrees±0.2 degrees, and a lowest diffraction peak at 7.3 degrees±0.2 degrees, having no diffraction peak between 7.3 degrees and 9.4 degrees, and having no diffraction peak at 26.3 degrees. FIG. 14 shows the measurement result.

Figure 15:
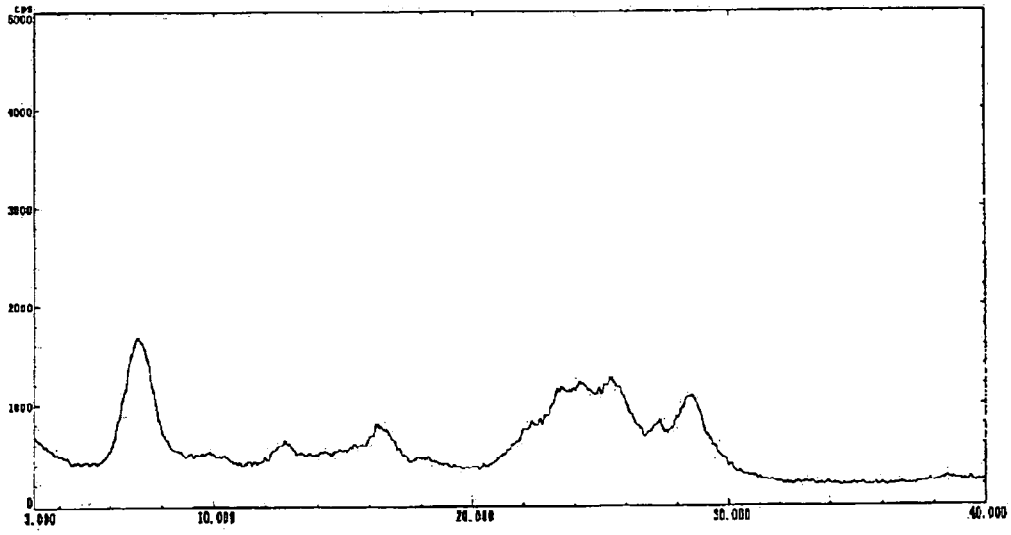
FIG. 15 is a view showing the XD spectrum of low-crystallinity titanylphthalocyanine obtained in Synthesis Example 1.

In addition, a part of the water paste obtained in Synthesis Example 1 was dried at a temperature of 80° C. under a reduced pressure of 5 mmHg for 2 days to thereby yield a low-crystallinity titanylphthalocyanine powder. FIG. 15 shows an X-ray diffraction spectrum of the dried power of the water paste.

[Measurement Conditions of X-ray Diffraction Spectrum]

X-ray tube: Cu
Voltage: 50 kV
Current: 30 mA
Scanning speed: 2 degrees/min
Scanning scope: 3 degrees to 40 degrees
Time constant: 2 seconds Synthesis Example 2

—Synthesis of Pigment 2—

According to the method described in Synthesis of Example 1, a water paste of a titanylphthalocyanine pigment was synthesized, and the synthetic product was subjected to a crystal conversion treatment as described in the following manner to thereby prepare a phthalocyanine crystal having primary particles smaller than those of Synthesis Example 1.

To 60 parts of the water paste obtained in Synthesis Example 1 before being subjected to a crystal conversion treatment, 400 parts of tetrahydrofuran was added, and the mixture was strongly stirred at 2,000 rpm using a homomixer (MARK IIf Model, available from KENIS Ltd.) at room temperature, and the stirring was stopped at the time when the navy blue water paste turned light blue 20 minutes later from start of the stirring, and the mixture was immediately vacuum filtered. The crystal obtained in the vacuum filter was washed with tetrahydrofuran to thereby yield a wet cake of the pigment. The wet cake was dried at a temperature of 70° C. under a reduced pressure of 5 mmHg for 2 days to thereby prepare 8.5 parts of a titanylphthalocyanine crystal. The titanylphthalocyanine crystal was taken as "pigment 2".

No halogenated material was used for the raw material of the pigment 2 obtained in Synthesis Example 2. The solid content concentration of the wet cake was 15%. The mass ratio of the solvent for crystal conversion relative to the wet cake was 44:1.

Next, a part of the obtained titanylphthalocyanine (water paste) before being subjected to a crystal conversion treatment in Synthesis Example 1 was diluted with ion exchange water so as to have a concentration of 1%, and the diluted water paste was skimmed with a copper mesh of which the surface thereof had been subjected to a conductive treatment, and the particle size of the titanylphthalocyanine was observed using a transmission electron microscope (TEM) (H-9000NAR, available from Hitachi, Ltd.) at 75,000 times magnification. Then, the average particle size of the titanylphthalocyanine was measured as stated below, and the titanylphthalocyanine had an average particle size of 0.06 μm.

—Measurement of Average Particle Size—

The observed transmission electron microscopic image was taken as a TEM photograph, 30 titanylphthalocyanine particles (formed in a needle-like shape) were arbitrarily selected from the TEM photograph image, and the major diameter of the respective titanylphthalocyanine particles was measured. The average major diameter of the measured 30 particles was calculated, and the calculated average major diameter was regarded as the average particle size of the titanylphthalocyanine.

The titanylphthalocyanine crystals of Synthesis Examples 1 and 2 that had been subjected to a crystal conversion treatment but just before being subjected to a filtration treatment were respectively diluted with tetrahydrofuran so as to have a concentration of 1%, and the diluted titanylphthalocyanine crystal was observed in the same manner as described above. Table 1 shows the result. Since all the titanylphthalocyanine crystal particles prepared in Synthesis Examples 1 and 2 were not necessarily formed in a similar shape, and there were crystal particles formed in close to a triangular shape or in close to a square shape, the length of a diagonal line of the biggest crystal was calculated and regarded as the major diameter of the titanylphthalocyanine crystals.

TABLE 1

| | Average particle size (μm) | Remark |
|---|---|---|
| Synthesis Example 1 (Pigment 1) | 0.31 | The crystal contained large particles having a particle diameter of 0.3 μm to 0.4 μm. |
| Synthesis Example 2 (Pigment 2) | 0.12 | The sizes of the crystal particles were substantially uniform. |

From the results shown in Table 1, it was recognized that the pigment 1 prepared in Synthesis Example 1 not only had a large average particle size but also contained coarse particles. In contrast, the pigment 2 prepared in Synthesis Example 2 not only had a small average particle size but the sizes of individual primary particles were substantially uniform.

Synthesis Example 3

—Synthesis of Pigment 3—

According to the method described in Example 1 of Japanese Patent Application Laid-Open (JP-A) No. 01-299874 (Japanese Patent (JP-B) No. 2512081), a pigment was prepared. Specifically, the wet cake prepared in Synthesis Example 1 was dried, 1 g of the obtained dry material was added to 50 g of polyethylene glycol, and the materials were ground together with 100 g of glass beads in a sand mill. After the powder was subjected to a crystal conversion treatment, the powder was washed with a diluted sulfuric acid, and an ammonium hydroxide aqueous solution sequentially, and then dried to thereby yield a pigment. The pigment was taken as "pigment 3". No halogenated material was used for the raw material of the pigment 3 prepared in Synthesis Example 3.

Synthesis Example 4

—Synthesis of Pigment 4—

According to the method described in Production Example 1 of Japanese Patent Application Laid Open (JP-A) No. 03-269064 (Japanese Patent (JP-B) No. 2584682), a pigment was prepared. Specifically, the wet cake prepared in Synthesis Example 1 was dried, 1 g of the obtained dry material was poured in a mixture solvent of 10 g of ion exchange water and 1 g of monochlorobenzene and stirred at a temperature of 50° C. for 1 hour, and then the material was washed with methanol and ion exchange water and dried to thereby yield a pigment. The pigment was taken as "pigment 4". No halogenated material was used for the raw material of the pigment 4 prepared in Synthesis Example 4.

Synthesis Example 5

—Synthesis of Pigment 5—

According to the method described in Production Examples of Japanese Patent Application Laid Open (JP-A) No. 02-8256 (Japanese Patent Application Publication (JP-B) No. 07-91486, a pigment was prepared. Specifically, 9.8 g of phthalodinitrile and 75 mL of 1-chloronaphthalene were stirred and mixed, and 2.2 mL of titanium tetrachloride was delivered by drops into the mixture under nitrogen gas stream. Upon completion of the dropping, the temperature of the mixture was gradually raised to 200° C., and a reaction was performed by stirring the mixture for 3 hours while keeping the reaction temperature between 200° C. and 220° C. After the reaction, the mixture was left intact to be cooled to the temperature of 130° C., and the mixture was filtered at that point in time. Next, the obtained powder was washed with 1-chloronaphthalene until the powder turned blue, and the powder was washed with methanol several times and further washed with hot water of 80° C. several times, and then dried to thereby yield a pigment. The pigment was taken as "pigment 5". No halogenated material was used for the raw material of the pigment 5 prepared in Synthesis Example 5.

Synthesis Example 6

—Synthesis of Pigment 6—

According to the method described in Synthesis Example 1 of Japanese Patent Application Laid Open (JP-A) No. 64-17066 (Japanese Patent Application publication (JP-B) No. 07-97221), a pigment was prepared. Specifically, 5 parts of α-TiOPc was ground together with 10 g of salt and 5 g of acetophenone at 100° C. in a sand grinder for 10 hours to perform a crystal conversion treatment. The powder was washed with ion exchange water and methanol, and purified with a diluted sulfuric acid aqueous solution and washed with ion exchange water until no acid content remained therein, and then dried to thereby yield a pigment. The pigment was taken as "pigment 6". No halogenated material was used for the raw material of the pigment 6 prepared in Synthesis Example 6.

Synthesis Example 7

—Synthesis of Pigment 7—

According to the method described in Example 1 of Japanese Patent Application Laid Open (JP-A) No. 11-5919 (Japanese Patent (JP-B) No. 3003664), a pigment was prepared. Specifically, 20.4 parts of o-phthalodinitrile and 7.6 parts of titanium tetrachloride were heated at 200° C. in 50 parts of quinoline for 2 hours for a reaction, and then the solvent was removed from the reactant by steam distillation. The reactant was purified with a 2% chloride aqueous solution and a 2% sodium hydroxide aqueous solution sequentially and washed with methanol, N,N-dimethylformamide and then dried to thereby yield titanylphthalocyanine. Thereafter, 2% of the titanylphthalocyanine was dissolved in 40 parts of a 98% sulfuric acid of 5° C. little by little, and the mixture was stirred for 1 hour while keeping the temperature at 5° C. or less. Subsequently, in 400 parts of ice water in which a sulfuric acid solution was stirred at high-speed, the mixture was slowly poured to obtain a precipitate, and the precipitated crystal was filtered. The crystal was washed with distilled water until no acid content remained therein to thereby yield a wet cake. The obtained wet cake was poured in 100 parts of tetrahydrofuran and stirred for around 5 hours, the stirred material was filtered, and the filtered product was washed with tetrahydrofuran and then dried to thereby yield a pigment. The pigment was taken as "pigment 7". No halogenated material was used for the raw material of the pigment 7 prepared in Synthesis Example 7.

Synthesis Example 8

—Synthesis of Pigment 8—

According to the method described in Synthesis Example 2 of Japanese Patent Application Laid Open (JP-A) No. 03-255456 (Japanese Patent (JP-B) No. 3005052), a pigment was prepared. Specifically, 10 parts of the wet cake prepared in Synthesis Example 1 was mixed with 15 parts of sodium chloride and 7 parts of diethylene glycol, and the mixture was milled in an automatic mortar at a heating temperature of 80° C. for 60 hours. Next, the treated product was sufficiently washed with water to completely remove the sodium chloride and diethylene glycol contained therein. Then, the product was dried under reduced pressures, and 200 parts of cyclohexanon and glass beads having a diameter of 1 mm were added to the dry material, and the materials were ground using a sand mill for 30 minutes to thereby yield a pigment. The pigment was taken as "pigment 8". No halogenated material was used for the raw material of the pigment 8 prepared in Synthesis Example 8.

Synthesis Example 9

—Synthesis of Pigment 9—

According to the method for producing a titanylphthalocyanine crystal described in Japanese Patent Application Laid Open (JP-A) No. 08-110649, a pigment was prepared. Specifically, 58 g of 1,3-diiminoisoindline and 51 g of tetrabutoxy titanium were reacted with 300 mL of a-chloronaphthalene at 210° C. for 5 hours, and the reactant was washed with α-chloronaphthalene, and dimethylformamide (DMF) in this order. Thereafter, the washed reactant was further washed with heated DMF, hot water, and methanol, and then dried to thereby yield 50 g of titanylphthalocyanine. Then, 4 g of the titanylphthalocyanine was added to 400 g of sulfuric acid that had been cooled to 0° C., and the mixture was stirred at 0° C. for 1 hour. After confirming that phthalocyanine was completely dissolved therein, the reactant was added to a mixture solution of 800 mL of water cooled to 0° C. and 800 mL of toluene. The mixture was stirred for 2 hours at room temperature, and then the precipitated phthalocyanine crystal was filtered and separated from the mixture solution, and then washed with methanol, and water in this order. After confirmation of neutrality of wash water, the phthalocyanine crystal was filtered and separated from the wash water, and then dried to thereby yield 2.9 g of a titanylphthalocyanine crystal. The titanylphthalocyanine crystal was taken as "pigment 9". No halogenated material was used for the raw material of the pigment 9 prepared in Synthesis Example 9.

The X-ray diffraction spectra of the pigments 3 to 9 prepared in Synthesis Examples 3 to 9 were respectively measured in the same manner as described above, and it was confirmed that the respective spectra resulted in the same results described in the each publication. The X-ray diffraction spectrum of the pigment prepared in Synthesis Example 2 agreed with that of the pigment prepared in Synthesis Example 1. Table 2 shows the X-ray diffraction spectra on the respective pigments, and characteristics of peaked position of X-ray diffraction spectrum of the pigment obtained in Synthesis Example 1.

TABLE 2

| | Pigment | Maximum peak position (degree) | Minimum peak position (degree) | Peak at 9.4 degrees | Peak at 9.6 degrees | Peak between 7.4 degrees to 9.4 degrees | Peak at 24.0 degrees | Peak at 26.3 degrees |
|---|---|---|---|---|---|---|---|---|
| Synthesis Ex. 1 | Pigment 1 | 27.2 | 7.3 | Observed | Observed | Not observed | Observed | Not observed |
| Synthesis Ex. 2 | Pigment 2 | 27.2 | 7.3 | Observed | Observed | Not observed | Observed | Not observed |
| Synthesis Ex. 3 | Pigment 3 | 27.2 | 7.3 | Not observed | Not observed | Not observed | Observed | Not observed |
| Synthesis Ex. 4 | Pigment 4 | 27.2 | 9.6 | Observed | Observed | Not observed | Observed | Not observed |
| Synthesis Ex. 5 | Pigment 5 | 27.2 | 7.4 | Not observed | Observed | Not observed | Not observed | Not observed |
| Synthesis Ex. 6 | Pigment 6 | 27.3 | 7.3 | Observed | Observed | Observed (7.5 degrees) | Observed | Not observed |
| Synthesis Ex. 7 | Pigment 7 | 27.2 | 7.5 | Not observed | Observed | Observed (7.5 degrees) | Observed | Not observed |
| Synthesis Ex. 8 | Pigment 8 | 27.2 | 7.4 | Not observed | Not observed | Observed (9.2 degrees) | Observed | Observed |
| Synthesis Ex. 9 | Pigment 9 | 27.2 | 7.3 | Observed | Observed | Not observed | Observed | Not observed |

Next, a method for preparing a coating solution for charge generating layer using the respective synthesized pigments (respective charge generating materials) will be described below.

Preparation Example 1

—Preparation of Coating Solution for Charge Generating Layer 1—

In a commercially available bead mill dispersing device, a coating solution for charge generating layer having the following composition was prepared. Specifically, 2-butanone in which polyvinylbutyral had been dissolved and the pigment 1 prepared in Synthesis Example 1 were poured in the dispersing device, and the materials were dispersed using a PSZ ball having a diameter of 0.5 mm at 1,200 rpm for 30 minutes to thereby prepare a coating solution for charge generating layer 1.

Titanylphthalocyanine pigment (pigment 1) . . . 15 parts

Polyvinylbutyral . . . 10 parts (BX-1, available from SEKISUI CHEMICAL CO., LTD.)

2-butanone . . . 280 parts

Preparation Examples 2 to 9

—Preparation of Coating Solutions for Charge Generating Layers 2 to 9—

Each dispersion liquids for Preparation Examples 2 to 9 were prepared in the same manner as in Preparation Example 1 except that the pigment 1 was replaced by the pigments 2 to 9, respectively. These dispersion liquids were made corresponding to the pigment numbers and were taken as coating solutions for charge generating layers 2 to 9.

Preparation Example 10

—Preparation of Coating Solution for Charge Generating Layer 10—

The coating solution for charge generating layer 1 prepared in Preparation Example 1 was filtered through a cotton wind cartridge filter (TCW-1-CS, effective pore size=1 μm, available from Advantech Co., Ltd.). In the filtration treatment, the coating solution was filtered under a pressurized condition using a pump. The filtered coating solution was taken as coating solution for charge generating layer 10.

Preparation Example 11

—Preparation of Coating Solution for Charge Generating Layer—

A dispersion liquid was prepared by filtering the coating solution for charge generating layer of Preparation Example 10 under a pressurized condition in the same manner as in Preparation Example 10 except that the filter used in Preparation Example 10 was replaced by a cotton wind cartridge filter (TCW-3-CS, effective pore size=3 μm, available from Advantech Co., Ltd.). The dispersion liquid was taken as coating solution for charge generating layer 11.

Preparation Example 12

—Preparation of Coating Solution for Charge Generating Layer 12—

A dispersion liquid was prepared by filtering the coating solution for charge generating layer of Preparation Example 10 under a pressurized condition in the same manner as in Preparation Example 10 except that the filter used in Preparation Example 10 was replaced by a cotton wind cartridge filter (TCW-5-CS, effective pore size=5 μm, available from Advantech Co., Ltd.). The dispersion liquid was taken as coating solution for charge generating layer 12.

Preparation Example 13

—Preparation of Coating Solution for Charge Generating Layer 13—

A dispersion liquid was prepared in the same manner as in Preparation Example 1 except that the dispersion conditions were changed such that the rotational speed of the rotor was 1,000 rpm and the rotation time was changed to 20 minutes. The dispersion liquid was taken as coating solution for charge generating layer 13.

Preparation Example 14

—Preparation of Coating Solution for Charge Generating Layer 14—

The dispersion liquid prepared in Preparation Example 13 was filtered through a cotton wind cartridge filter (TCW-1-CS, effective pore size=1 μm, available from Advantech Co., Ltd.). In the filtration treatment, the dispersion liquid was filtered under a pressurized condition using a pump. The dispersion liquid was taken as coating solution for charge generating layer 14.

The particle size distribution of pigment particles in the thus prepared coating solutions for charge generating layers was measured using a particle size distribution measuring device (CAPA-700, available from HORIBA Instruments Inc.). Table 3 shows the measurement results.

TABLE 3

| | Volume average particle diameter (μm) | Standard deviation (μm) |
|---|---|---|
| Coating solution for charge generating layer 1 | 0.29 | 0.18 |
| Coating solution for charge generating layer 2 | 0.19 | 0.13 |
| Coating solution for charge generating layer 3 | 0.28 | 0.19 |
| Coating solution for charge generating layer 4 | 0.31 | 0.20 |
| Coating solution for charge generating layer 5 | 0.30 | 0.20 |
| Coating solution for charge generating layer 6 | 0.27 | 0.19 |
| Coating solution for charge generating layer 7 | 0.29 | 0.20 |
| Coating solution for charge generating layer 8 | 0.27 | 0.18 |
| Coating solution for charge generating layer 9 | 0.26 | 0.19 |
| Coating solution for charge generating layer 10 | 0.22 | 0.16 |
| Coating solution for charge generating layer 11 | 0.24 | 0.17 |
| Coating solution for charge generating layer 12 | 0.28 | 0.18 |
| Coating solution for charge generating layer 13 | 0.33 | 0.23 |

For the coating solution for charge generating layer 14, the filter was clogged in the course of filtration treatment, it was impossible to filter the whole of the dispersion liquid, and thus it was impossible to measure the particle size distribution of the dispersion liquid.

Preparation Example 15

—Preparation of Coating Solution for Charge Generating Layer 15—

A dispersion liquid composed of the following composition was prepared using a ball mill. The dispersion was performed for 72 hours to thereby prepare coating solution for charge generating layer 15.

Butyral resin . . . 5 parts (ESLEC BMS, available from SEKISUI CHEMICAL CO., LTD.)

Triazo pigment represented by the following structural formula . . . 15 parts

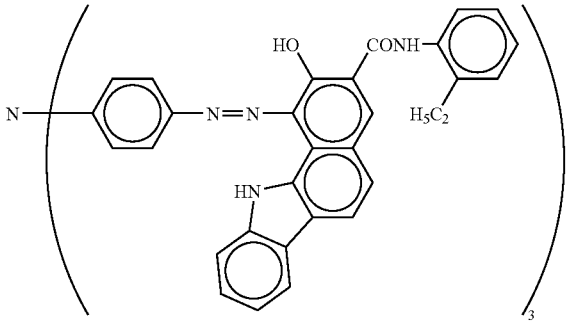

Cyclohexanon . . . 700 parts 2-butanone . . . 300 parts

Synthesis Example 10

—Synthesis of Resin for Charge Blocking Layer—

In 160 parts of methanol, 100 parts of 6-nylon were dissolved, 75 parts of formaldehyde and 2 parts of phosphoric acid were mixed therewith, the mixture was stirred, and the temperature of the mixture was raised to 125° C. in one hour. The temperature of the mixture was kept at 125° C. for 30 minutes and then lowered to room temperature in 45 minutes. The mixture was in a translucent gel condition.

To neutralize phosphoric acid, the gel was dissolved in 95% ethanol containing an excessive amount of ammonia. The solution was poured into water to precipitate polyamide.

The precipitated polyamide was filtered and washed with 1 L of tap water, and further dried to synthesize N-methoxymethyl nylon.

—Preparation of Coating Solution for Charge Blocking Layer—

The N-methoxymethylated nylon was dissolved in a solvent at the composition ratio stated below to thereby prepare a coating solution for charge blocking layer.

N-methoxymethylated nylon used in Synthesis Example 10 . . . 6.4 parts

Methanol . . . 70 parts n-butanol . . . 30 parts

—Preparation of Coating Solution for Moiré Preventing Layer—

A mixture prepared at the following composition ratio was dispersed using a ball mill for 72 hours to thereby prepare a coating solution for moiré preventing layer.

Titanium oxide (purity: 99.8%) . . . 70 parts

Alkyd resin . . . 14 parts (BECKOLITE M6401-50-S (solid content: 50%), available from Dainippon Ink and Chemicals, Inc.)

Melamine resin . . . 10 parts (Super Beckamine G-821-60 (solid content: 60%), available from Dainppon Ink and Chemicals, Inc.)

2-butanon . . . 100 parts

—Preparation of Coating Solution for Charge Transporting Layer—

Polycarbonate . . . 10 parts (TS2050, available from Teijin Chemicals, Ltd.)

Charge transporting material represented by the following structural formula . . . 7 parts Tetrahydrofuran . . . 80 parts

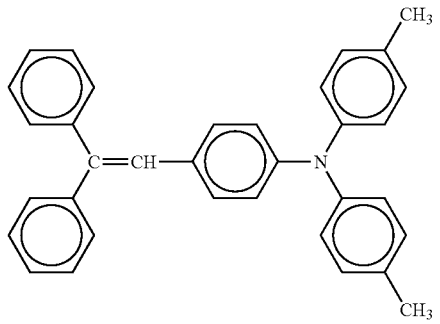

Example 1

—Preparation of Latent Electrostatic Image Bearing Member—

An aluminum cylinder (JIS 1050) having a diameter of 100 mm was coated with the coating solution for charge blocking layer, the coating solution for moiré preventing layer, the coating solution for charge generating layer 2, and the coating solution for charge transporting layer in this order, and the surface of the cylinder with the respective coating solution applied thereon was dried to form a charge blocking layer of 1.0 μm in thickness, a moiré preventing layer of 3.5 μm in thickness, a charge generating layer of 0.3 μm in thickness, and a charge transporting layer of 30 μm in thickness thereon respectively to thereby prepare a latent electrostatic image bearing member. Next, the obtained latent electrostatic image bearing member was heated at 100° C. for 10 hours. In this way, a latent electrostatic image bearing member of Example 1 was prepared.

Example 2

—Preparation of Latent Electrostatic Image Bearing Member—

A latent electrostatic image bearing member of Example 2 was prepared in the same manner as in Example 1 except that the thickness of the charge transporting layer was changed to 40 μm.

Example 3

—Preparation of Latent Electrostatic Image Bearing Member—

A latent electrostatic image bearing member of Example 3 was prepared in the same manner as in Example 1 except that the thickness of the charge transporting layer was changed to 50 μm.

Example 4

—Preparation of Latent Electrostatic Image Bearing Member—

A latent electrostatic image bearing member of Example 4 was prepared in the same manner as in Example 1 except that an aluminum cylinder (JIS 1050) having a diameter of 100 mm was coated with the coating solution for moiré preventing layer, the coating solution for charge generating layer 2, and the coating solution for charge transporting layer in this order, and the surface of the cylinder with these coating solutions applied thereon was dried to form a moiré preventing layer of 3.5 μm in thickness, a charge generating layer of 0.3 μm in thickness, and a charge transporting layer of 30 μm in thickness thereon respectively, without forming a charge blocking layer, to prepare a latent electrostatic image bearing member. Subsequently, the obtained latent electrostatic image bearing member was heated at 100° C. for 10 hours to thereby prepare a latent electrostatic image bearing member of Example 4.

Example 5

—Preparation of Latent Electrostatic Image Bearing Member—

A latent electrostatic image bearing member of Example 5 was prepared in the same manner as in Example 1 except that the purity of titanium oxide used for the coating solution for moiré preventing layer was changed to 97.8%.

Examples 6 to 10

—Preparation of Latent Electrostatic Image Bearing Member—

Latent electrostatic image bearing members of Examples 6 to 10 were respectively prepared in the same manner as in Example 1 to 5 except that the respective latent electrostatic image bearing members were subjected to a corona discharge treatment for 120 hours under a constant condition of a potential of the respective latent electrostatic image bearing member being 1,500 (−V), instead of heating the respective latent electrostatic image bearing members.

Comparative Examples 1 to 5

—Preparation of Latent Electrostatic Image Bearing Member—

Latent electrostatic image bearing members of Comparative Examples 1 to 5 were respectively prepared in the same manner as in Examples 1 to 5 except that the respective latent electrostatic image bearing members were not heated.

Comparative Example 6

—Preparation of Latent Electrostatic Image Bearing Member—

A latent electrostatic image bearing member of Comparative Example 6 was prepared in the same manner as in Example 1 except that the thickness of the charge transporting layer was changed to 25 μm.

Comparative Example 7

—Preparation of Latent Electrostatic Image Bearing Member—

A latent electrostatic image bearing member of Comparative Example 7 was prepared in the same manner as in Example 1 except that the thickness of the charge transporting layer was changed to 55 μm.

Example 11

—Preparation of Latent Electrostatic Image Bearing Member—

An aluminum cylinder (JIS1050) having a diameter of 100 mm was coated with the coating solution for charge blocking layer, the coating solution for moiré preventing layer, the coating solution for charge generating layer 2, and a coating solution for charge transporting layer 2 composed of the following composition in this order, and the surface of the cylinder with the respective coating solution applied thereon was dried to form a charge blocking layer of 1.0 μm in thickness, a moiré preventing layer of 3.5 μm in thickness, a charge generating layer of 0.3 μm in thickness, and a charge transporting layer of 30 μm in thickness thereon respectively to thereby prepare a latent electrostatic image bearing member of Example 11.

—Preparation of Coating Solution for Charge Transporting Layer 2—

Polycarbonate resin . . . 10 parts (TS2050, available from Teijin Chemicals, Ltd.)

Charge transporting material represented by the following structural formula . . . 7 parts

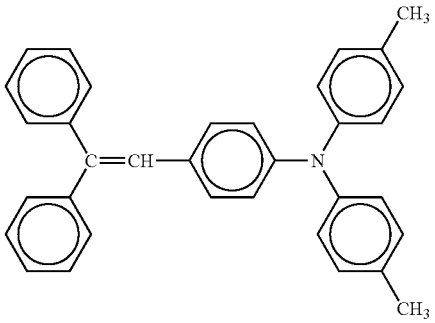

Dichloromethane . . . 80 parts

Two of the thus prepared latent electrostatic image bearing members were used for each test on each of the latent electrostatic image bearing members of Examples 1 to 11 and Comparative Examples 1 to 7. For one of the two latent electrostatic image bearing members, a small portion was cut to 20 μm in depth in an oblique direction from the surface thereof under the following conditions using a surface and interface cutting analyzer (SAICAS, DN-20, available from Daipla Wintes), and the distribution of absorbance ratio between the charge transporting material and the binder resin in the thickness direction of the oblique portion was examined by μ-ATR method under the following conditions to check the presence or absence of inflection points. The square of a correlation coefficient "r" between the absorbance ratio of the charge transporting material and the binder resin measured by infrared spectroscopy and the distance from the surface of the charge transporting layer in the thickness direction was determined as follows. Table 4 shows the results.

[Conditions for Small Amount Cutting]

For the cutting angle, the latent electrostatic image bearing member was cut to 20 μm in depth from the surface thereof at an inclination of 1 μm in the depth direction and 20 μm in lateral direction.

[μ-ATR Measurement Conditions]

Measuring device: Spectrum Spotlight 2000 FT-IR Imaging System (available from Perkin Elmer)

Aperture size: 10 μm×100 μm

Resolving power: 4 $cm^{-1}$

[How to Determine Correlation Coefficient]

(1) Using spreadsheet software, Excel (available from Microsoft), a value of distance from the surface of the charge transporting layer to the end in the thickness direction was input as an X axis, and a value of the absorbance ratio between the charge transporting material and the binder resin measured by infrared spectroscopy was input as a Y axis. (2) A scatter diagram was prepared based on the values by utilizing the graph function of Excel. (3) An approximate curve was drawn on the scatter diagram, and a linear approximation was selected, and then the square value of the correlation coefficient was calculated.

For another latent electrostatic image bearing member, the image bearing member was mounted to an image forming apparatus (imagio Neo 1050 Pro, available from Ricoh Company Ltd.). After a running output of 1,000,000 sheets using 6% image-area ratio chart, images in white solid part and in halftone were output, and the latent electrostatic image bearing member was evaluated as to toner filming and presence or absence of occurrence of background smear based on the following criteria. Table 4 shows the evaluation results.

[Evaluation Criteria]

A: Extremely excellent

B: Excellent

C: A bit better than the permissible level

D: Very poor

TABLE 4

| | Inflection point | Square of correlation coefficient "r" | Toner filming | Background smear | Resolution |
|---|---|---|---|---|---|
| Ex. 1 | Not observed | 0.99 | A | A | A |
| Ex. 2 | Not observed | 0.98 | A | A | A |
| Ex. 3 | Not observed | 0.97 | A | A | C |
| Ex. 4 | Not observed | 0.99 | A | C | A |
| Ex. 5 | Not observed | 0.99 | A | B | A |
| Ex. 6 | Not observed | 0.96 | A | A | A |
| Ex. 7 | Not observed | 0.94 | A | A | A |
| Ex.8 | Not observed | 0.93 | A | A | A |
| Ex. 9 | Not observed | 0.96 | A | C | A |
| Ex. 10 | Not observed | 0.96 | A | B | A |
| Ex. 11 | Not observed | 0.98 | A | C | A |
| Compara. Ex. 1 | Observed | 0.90 | D | A | A |
| Compara. Ex. 2 | Observed | 0.87 | D | A | A |
| Compara. Ex. 3 | Observed | 0.82 | D | A | C |
| Compara. Ex. 4 | Observed | 0.90 | D | C | A |
| Compara. Ex. 5 | Observed | 0.90 | D | B | A |
| Compara. Ex. 6 | Not observed | 0.99 | A | D | A |

TABLE 4-continued

| | Inflection point | Square of correlation coefficient "r" | Toner filming | Background smear | Resolution |
|---|---|---|---|---|---|
| Compara. Ex. 7 | Not observed | 0.95 | A | A | D |

The results shown in Table 4 demonstrate that each of the latent electrostatic image bearing members of Examples 1 to 11 caused a few occurrences of abnormal images such as toner filming and background smear and allowed stable formation of images, as compared to the latent electrostatic image bearing members of Comparative Examples 1 to 7.

The latent electrostatic image bearing member of Example 11 was evaluated as extremely excellent as to toner filming because a halogenated solvent was used as a raw material, however, it had a heavy environmental burden and resulted in slightly poorer evaluation on background smear than the latent electrostatic image bearing member of Example 1.

Examples 12 to 14

Latent electrostatic image bearing members of Examples 12 to 14 were respectively prepared in the same manner as in Examples 1 to 3 except that each of the latent electrostatic image bearing members was exposed with an ultraviolet ray using a metal halide lamp of 80 W/cm with an exposure distance of 120 mm and an exposure dose of 100 m/cm$^2$ for 1 minute, instead of heating the respectively prepared latent electrostatic image bearing members with a charge transporting layer formed on the surface thereof at 100° C. for 10 hours.

Examples 15 to 17

Latent electrostatic image bearing members of Examples 15 to 17 were respectively prepared in the same manner as in Examples 1 to 3 except that each of the latent electrostatic image bearing members was heated at 120° C. for 5 hours, instead of heating the respectively prepared latent electrostatic image bearing members with a charge transporting layer formed on the surface thereof at 100° C. for 10 hours.

Comparative Examples 8 to 10

Latent electrostatic image bearing members of Comparative Examples 8 to 10 were respectively prepared in the same manner as in Examples 1 to 3 except that each of the respectively prepared latent electrostatic image bearing members with a charge transporting layer formed on the surface thereof was not subjected to a heat treatment.

Comparative Example 11

A latent electrostatic image bearing member of Comparative Example 11 was prepared in the same manner as in Example 1 except that the thickness of the charge transporting layer was changed to 25 μm.

Comparative Example 12

A latent electrostatic image bearing member of Comparative Example 12 was prepared in the same manner as in Example 1 except that the thickness of the charge transporting layer was changed to 55 μm.

Two of the thus prepared latent electrostatic image bearing members were used for each test on each of the latent electrostatic image bearing members of Examples 12 to 17 and Comparative Examples 8 to 12. For one of the two latent electrostatic image bearing members, a small portion was cut to 5 μm in depth in an oblique direction from the surface thereof under the following conditions using a surface and interface cutting analyzer (SAICAS, DN-20, available from Daipla Wintes), and the absorbance ratio between the charge transporting material and the binder resin in the surface of the oblique portion and in inside portion of 5 μm from the surface of the oblique portion was examined by μ-ATR method under the following conditions. Table 5 shows the results.

[Conditions for Small Amount Cutting]

For the cutting angle, the latent electrostatic image bearing member was cut to 5 μm in depth from the surface thereof at an inclination of 1 μm in the depth direction and 20 μm in lateral direction.

[μ-ATR Measurement Conditions]

Measuring device: Spectrum Spotlight 2000 FT-IR Imaging System (available from Perkin Elmer)

Aperture size: 10 μm×100 μm

Resolving power: 4 cm$^{-1}$

For another latent electrostatic image bearing member, the image bearing member was mounted to an image forming apparatus (imagio Neo 1050 Pro, available from Ricoh Company Ltd.). After a running output of 1,000,000 sheets using 6% image-area ratio chart, images in white solid part and in halftone were output, and the latent electrostatic image bearing member was evaluated as to toner filming and presence or absence of occurrence of background smear based on the following criteria. Table 5 shows the evaluation results.

[Evaluation Criteria]

A: Extremely excellent

B: Excellent

C: A bit better than the permissible level

D: Very poor

TABLE 5

| | Absorbance ratio of 5 μm inside portion/Absorbance ratio of surface | Toner filming | Background smear | Resolution |
|---|---|---|---|---|
| Ex. 12 | 1.02 | A | A | A |
| Ex. 13 | 1.05 | A | A | A |
| Ex. 14 | 1.12 | B | A | C |
| Ex. 15 | 1.01 | A | A | A |
| Ex. 16 | 1.03 | A | A | A |
| Ex. 17 | 1.07 | A | A | C |
| Compara. Ex. 8 | 1.19 | D | A | A |
| Compara. Ex. 9 | 1.24 | D | A | A |
| Compara. Ex. 10 | 1.32 | D | A | C |
| Compara. Ex. 11 | 1.01 | A | D | A |
| Compara. Ex. 12 | 1.09 | A | A | D |

Example 18

—Preparation of Latent Electrostatic Image Bearing Member—

A latent electrostatic image bearing member of Example 18 was prepared in the same manner as in Example 1 except that the coating solution for charge generating layer 2 was changed to the coating solution for charge generating layer 1.

Example 19

—Preparation of Latent Electrostatic Image Bearing Member—

A latent electrostatic image bearing member of Example 19 was prepared in the same manner as in Example 1 except that the coating solution for charge generating layer 2 was changed to the coating solution for charge generating layer 3.

Example 20

—Preparation of Latent Electrostatic Image Bearing Member—

A latent electrostatic image bearing member of Example 20 was prepared in the same manner as in Example 1 except that the coating solution for charge generating layer 2 was changed to the coating solution for charge generating layer 4.

Example 21

—Preparation of Latent Electrostatic Image Bearing Member—

A latent electrostatic image bearing member was prepared in the same manner as in Example 1 except that the coating solution for charge generating layer 2 was changed to the coating solution for charge generating layer 5.

Example 22

—Preparation of Latent Electrostatic Image Bearing Member—

A latent electrostatic image bearing member was prepared in the same manner as in Example 1 except that the coating solution for charge generating layer 2 was changed to the coating solution for charge generating layer 6.

Example 23

—Preparation of Latent Electrostatic Image Bearing Member—

A latent electrostatic image bearing member was prepared in the same manner as in Example 1 except that the coating solution for charge generating layer 2 was changed to the coating solution for charge generating layer 7.

Example 24

—Preparation of Latent Electrostatic Image Bearing Member—

A latent electrostatic image bearing member was prepared in the same manner as in Example 1 except that the coating solution for charge generating layer 2 was changed to the coating solution for charge generating layer 8.

Example 25

—Preparation of Latent Electrostatic Image Bearing Member—

A latent electrostatic image bearing member was prepared in the same manner as in Example 1 except that the coating solution for charge generating layer 2 was changed to the coating solution for charge generating layer 9.

Example 26

—Preparation of Latent Electrostatic Image Bearing Member—

A latent electrostatic image bearing member was prepared in the same manner as in Example 1 except that the coating solution for charge generating layer 2 was changed to the coating solution for charge generating layer 10.

Example 27

—Preparation of Latent Electrostatic Image Bearing Member—

A latent electrostatic image bearing member was prepared in the same manner as in Example 1 except that the coating solution for charge generating layer 2 was changed to the coating solution for charge generating layer 11.

Example 28

—Preparation of Latent Electrostatic Image Bearing Member—

A latent electrostatic image bearing member was prepared in the same manner as in Example 1 except that the coating solution for charge generating layer 2 was changed to the coating solution for charge generating layer 12.

Example 29

—Preparation of Latent Electrostatic Image Bearing Member—

A latent electrostatic image bearing member was prepared in the same manner as in Example 1 except that the coating solution for charge generating layer 2 was changed to the coating solution for charge generating layer 13.

Example 30

—Preparation of Latent Electrostatic Image Bearing Member—

A latent electrostatic image bearing member was prepared in the same manner as in Example 1 except that the coating solution for charge generating layer 2 was changed to the coating solution for charge generating layer 15.

<Evaluation>

Two of the thus prepared latent electrostatic image bearing members were used for each test on each of the latent electrostatic image bearing members of Example 1 and Examples 18 to 30. For one of the two latent electrostatic image bearing members, a small portion was cut to 20 μm in depth in an oblique direction from the surface thereof under the following conditions using a surface and interface cutting analyzer (SAICAS, DN-20, available from Daipla Wintes), and the absorbance ratio between the charge transporting material and the binder resin in the thickness direction of the oblique small portion was examined by μ-ATR method under the following conditions to check the presence and absence of inflection points. The square of a correlation coefficient "r" between the absorbance ratio of the charge transporting material and the binder resin measured by infrared spectroscopy and the distance from the surface of the charge transporting layer in the thickness direction was determined as follows. Table 6 shows the results.

[Conditions for Small Amount Cutting]

For the cutting angle, the latent electrostatic image bearing member was cut to 20 μm in depth from the surface thereof at an inclination of 1 μm in the depth direction and 20 μm in lateral direction.

[μ-ATR Measurement Conditions]

Measuring device: Spectrum Spotlight 2000 FT-IR Imaging System (available from Perkin Elmer)

Aperture size: 10 μm×100 μm

Resolving power: 4 $cm^{-1}$

[How to Determine Correlation Coefficient]

(1) Using spreadsheet software, Excel (available from Microsoft), a value of distance from the surface of the charge transporting layer to the end in the thickness direction was input as an X axis, and a value of the absorbance ratio between the charge transporting material and the binder resin measured by infrared spectroscopy was input as a Y axis. (2) A scatter diagram was prepared based on the values by utilizing the graph function of Excel. (3) An approximate curve was drawn on the scatter diagram, and a linear approximation was selected, and then the square value of the correlation coefficient was calculated.

Another latent electrostatic image bearing member was mounted to an image forming apparatus shown in FIG. 11 which was remodeled such that all the elements other than three elements of a semiconductor laser having a wavelength of 780 nm as a light source for image exposure (image writing using a polygon mirror); an electric scorotoron charger as a charge member (charge conditions: DC bias, −1300V); and a charge elimination lamp were removed. A 6% image-area ratio chart was used to perform electrostatic fatigue durability test for 300 hours continuously without passing sheets through the image forming apparatus. Thereafter, the latent electrostatic image bearing member was detached from the image forming apparatus and then mounted to a not-remodeled image forming apparatus (imagio Neo 1050 Pro, available from Ricoh Company Ltd.), and images in white solid part and in halftone were output, and the latent electrostatic image bearing member was evaluated as to image density and presence or absence of occurrence of background smear based on the following criteria. Table 6 shows the evaluation results.

[Evaluation Criteria]

A: Extremely excellent

B: Excellent

C: A bit better than the permissible level

D: Very poor

TABLE 6

| | Coating solution for charge generating layer | Inflection point | Square of correlation coefficient "r" | Image density | Background smear |
|---|---|---|---|---|---|
| Ex. 1 | Coating solution 2 | Not observed | 0.99 | A | A |
| Ex. 18 | Coating solution 1 | Not observed | 0.99 | A | B |
| Ex. 19 | Coating solution 3 | Not observed | 0.99 | B | B |
| Ex. 20 | Coating solution 4 | Not observed | 0.99 | B | C |
| Ex. 21 | Coating solution 5 | Not observed | 0.99 | B | B |
| Ex. 22 | Coating solution 6 | Not observed | 0.99 | B | B |
| Ex. 23 | Coating solution 7 | Not observed | 0.99 | B | B |
| Ex. 24 | Coating solution 8 | Not observed | 0.99 | B | B |
| Ex. 25 | Coating solution 9 | Not observed | 0.99 | B | C |
| Ex. 26 | Coating solution 10 | Not observed | 0.99 | A | A |
| Ex. 27 | Coating solution 11 | Not observed | 0.99 | A | A |
| Ex. 28 | Coating solution 12 | Not observed | 0.99 | A | B |
| Ex. 29 | Coating solution 13 | Not observed | 0.99 | B | C |
| Ex. 30 | Coating solution 15 | Not observed | 0.99 | C | C |

The results shown in Table 6 demonstrate that the method for producing a latent electrostatic image bearing member of the present invention enables producing a latent electrostatic image bearing member which is durable in practical use without depending on materials used for the charge generating layer.

The latent electrostatic image bearing member prepared in Example 30 in which an azo pigment was used as the raw material of the charge generating material caused reduction in image density after being repeatedly used as compared to the latent electrostatic image bearing members of Example 1 and Examples 18 to 29 in which titanylphthalocyanine was used as the raw material of the charge generating material.

It is found that even when titanylphthalocyanine is used as a charge generating layer, the latent electrostatic image bearing member can exhibit excellent properties, provided that the titanylphthalocyanine has a specific crystal shape (the crystal shape of titanylphthalocyanine of Synthesis Example 1), and it is also found that even when the titanylphthalocyanine having a crystal shape of Synthesis Example 1 is used, the durability of background smear of the latent electrostatic image bearing member after being repeatedly used is particularly excellent (Example 1, Example 26, and Example 27). This verifies that as a method for controlling primary particles to have a particle diameter of 0.25 μm or less, both of a method of making the particle size smaller at the time of synthesis of titanylphthalocyanine and a method of removing coarse particles after a dispersion treatment of titanylphthalocyanine raw materials are effectual.

Examples 31 to 34 and Comparative Examples 13 to 16

Latent electrostatic image bearing members of Examples 31 to 34 and Comparative Examples 13 to 16 were respectively prepared in the same manner as in Examples 1 to 4 and Comparative Examples 1 to 4 except that the cylinder was changed to an aluminum cylinder (JIS1050) having a diameter of 30 mm.

<Evaluation>

Two of the thus prepared latent electrostatic image bearing members were used for each test on each of the latent electrostatic image bearing members of Examples 31 to 34 and Comparative Examples 1 to 4. For one of the two latent electrostatic image bearing members, a small portion was cut to 20 μm in depth in an oblique direction from the surface thereof under the following conditions using a surface and interface cutting analyzer (SAICAS, DN-20, available from Daipla Wintes), and the absorbance ratio between the charge transporting material and the binder resin in the thickness direction of the oblique small portion was examined by μ-ATR method under the following conditions to check the presence and absence of inflection points. The square of a correlation coefficient "r" between the absorbance ratio of the charge transporting material and the binder resin measured by infrared spectroscopy and the distance from the surface of the charge transporting layer in the thickness direction was determined as follows. Table 7 shows the results.

[Conditions for Small Amount Cutting]

For the cutting angle, the latent electrostatic image bearing member was cut to 20 μm in depth from the surface thereof at an inclination of 1 μm in the depth direction and 20 μm in lateral direction.

[μ-ATR Measurement Conditions]

Measuring device: Spectrum Spotlight 2000 FT-IR Imaging System (available from Perkin Elmer)

Aperture size: 10 μm×100 μm

Resolving power: 4 $cm^{-1}$

[How to Determine Correlation Coefficient]

(1) Using spreadsheet software, Excel (available from Microsoft), a value of distance from the surface of the charge transporting layer to the end in the thickness direction was input as an X axis, and a value of the absorbance ratio between the charge transporting material and the hinder resin measured by infrared spectroscopy was input as a Y axis. (2) A scatter diagram was prepared based on the values by utilizing the graph function of Excel. (3) An approximate curve was drawn on the scatter diagram, and a linear approximation was selected, and then the square value of the correlation coefficient was calculated.

Another latent electrostatic image bearing member was mounted to a process cartridge shown in FIG. 13, and the process cartridge was mounted to a tandem full-color image forming apparatus shown in FIG. 12. For a light source for image exposure, a semiconductor laser having a wavelength of 780 nm (image writing using a polygon mirror) was used. As a charge member, a charge roller with an insulating tape 50 μm in thickness wound on image-not-formed portions at both ends of the charge roller to thereby arrange the charge roller close to the latent electrostatic image bearing member (photoconductor). As the charging conditions, the DC bias was set to 900 (−V) and AC bias [Vpp (peak to peak): 1.9 kV, and frequency: 1.0 kHz] was superposed thereon, and the developing bias was set to 650 (−V). The process cartridges equipped with respective photoconductor samples were filled with the same developer and set to a cyan station, a magenta station, a yellow station, and a black station, and an image was repeatedly output on 40,000 sheets in total while rotating these stations for every 10,000 sheets. Then, images in white solid part and in halftone were output to evaluate the photoconductor sample as to toner filming and presence and absence of occurrences of background smear based on the following criteria. Table 7 shows the evaluation results. The test was performed under the conditions of 28° C. and 75% RH.

[Evaluation Criteria]

A: Extremely excellent

B: Excellent

C: A bit better than the permissible level

D: Very poor

TABLE 7

| | Inflection point | Square of correlation coefficient "r" | Toner filming | Background smear | Resolution |
|---|---|---|---|---|---|
| Ex. 31 | Not observed | 0.98 | A | A | A |
| Ex. 32 | Not observed | 0.97 | A | A | A |
| Ex. 33 | Not observed | 0.96 | A | A | C |
| Ex. 34 | Not observed | 0.99 | A | C | A |
| Compara. Ex. 13 | Observed | 0.91 | D | A | A |
| Compara. Ex. 14 | Observed | 0.86 | D | A | A |
| Compara. Ex. 15 | Observed | 0.83 | D | A | C |
| Compara. Ex. 16 | Observed | 0.89 | D | C | A |

The results shown in Table 7 demonstrate that by using the latent electrostatic image bearing member of the present invention, stable formation of images is possible without substantially causing abnormal images such as toner filming and background smear, even after the latent electrostatic image bearing member is repeatedly used.

An image forming method, an image forming apparatus, and a process cartridge using the latent electrostatic image bearing member of the present invention allow stable formation of images without substantially causing abnormal images such as toner filming and background smear and can be widely used in full-color copiers, full-color laser printers, and full-color plain paper facsimiles, etc., in which a direct or indirect electrophotographic polychromatic image developing process is used.

What is claimed is:

1. A latent electrostatic image bearing member comprising:

a support, a charge generating layer, and a charge transporting layer, the charge generating layer and the charge transporting layer being arranged in this order on or above the support, wherein the charge transporting layer comprises at least a charge transporting material and a binder resin and has a thickness of 30 μm to 50 μm; and the distribution representing the relation between the absorbance ratio of the charge transporting material and the binder resin measured by infrared spectroscopy and the distance from the surface of the charge transporting layer toward the thickness direction thereof represents a generally linear shape without having inflection points within 20 μm from the surface of the charge transporting layer toward the thickness thereof.

2. The latent electrostatic image bearing member according to claim 1, wherein the square of a correlation coefficient between the absorbance ratio of the charge transporting material and the binder resin measured by infrared spectroscopy and the distance from the surface of the charge transporting layer toward the thickness direction thereof is 0.92 or more within 20 μm from the surface of the charge transporting layer toward the thickness direction thereof

3. A latent electrostatic image bearing member comprising:

a support, a charge generating layer, and a charge transporting layer, the charge generating layer and the charge transporting layer being arranged in this order on or above the support, wherein the charge transporting layer comprises at least a charge transporting material and a binder resin and has a thickness of 30 μm to 50 μm; and an absorbance ratio A between the charge transporting material and the binder resin in the surface of the charge transporting layer measured by infrared spectroscopy and an absorbance ratio B between the charge transporting material and the binder resin at 5 μm inside from the surface of the charge transporting layer measured by infrared spectroscopy satisfy the equation, B/A=1.0 to 1.15.

4. The latent electrostatic image bearing member according to claim 1, wherein the charge transporting layer is formed by applying a coating solution for charge transporting layer containing at least a charge transporting material, a binder resin, and a non-halogenated solvent over the surface of the charge generating layer, and drying the charge generating layer surface with the coating solution applied thereon.

5. The latent electrostatic image bearing member according to claim 1, further comprising a charge blocking layer and a moiré preventing layer arranged in this order between the support and the charge generating layer.

6. The latent electrostatic image bearing member according to claim 5, wherein the charge blocking layer comprises at least an N-alkoxymethylated nylon.

7. The latent electrostatic image bearing member according to claim 5, wherein the moiré preventing layer comprises at least a titanium oxide with a purity of 99.0% or more and a crosslinkable resin.

8. The latent electrostatic image bearing member according to claim 1, wherein the charge generating layer comprises at least a charge generating material, and the charge generating material is a titanylphthalocyanine crystal.

9. The latent electrostatic image bearing member according to claim 8, wherein the titanylphthalocyanine crystal has a highest diffraction peak, as the Bragg angle 2θ diffraction peak of ±0.2 degrees relative to characteristic X-rays of CuKα having a wavelength of 15.42 nm, at least at 27.2 degrees, further has primary peaks at 9.4 degrees, 9.6 degrees, and 24.0 degrees, and a peak at 7.3 degrees as the diffraction peak of the lowest angle side, but has no peak between the peak at 7.3 degrees and the peak at 9.4 degrees, and has no peak at 26.3 degrees; and the volume average particle diameter of primary particles is 0.25 μm or less.

10. The latent electrostatic image bearing member according to claim 8, wherein the charge generating layer is formed from a dispersion liquid containing a titanylphthalocyanine crystal, and the dispersion liquid containing the titanylphthalocyanine crystal is prepared by dispersing the titanylphthalocyanine crystal in a solvent until the volume average particle diameter of the titanylphthalocyanine crystal is 0.3 μm or less and the standard deviation of the titanylphthalocyanine crystal is 0.2 μm or less, and passing the dispersion liquid through a filter having an effective pore size of 0.3 μm or less.

11. The latent electrostatic image bearing member according to claim 8, wherein the titanylphthalocyanine crystal has a highest diffraction peak, as the Bragg angle 2θ diffraction peak of ±0.2 degrees relative to characteristic X-rays of CuKα having a wavelength of 15.42 nm, at least at 7.0 degrees to 7.5 degrees; the half width of the highest diffraction peak is 1 degree or more; and the titanylphthalocyanine crystal can be obtained by subjecting an indefinitely shaped or low-crystallinity titanylphthalocyanine crystal having a volume average particle diameter of 0.1 μm or less to a crystal conversion treatment using an organic solvent in the presence of water, and filtering the titanylphthalocyanine crystal solution in a condition where the volume average particle diameter of primary particles after being subjected to the crystal conversion treatment is 0.25 μm or less.

12. The latent electrostatic image bearing member according to claim 8, wherein the raw material of the titanylphthalocyanine crystal is a compound containing no halogen.

13. The latent electrostatic image bearing member according to claim 11, wherein the indefinitely shaped or low-crystallinity titanylphthalocyanine crystal is prepared by acid paste method and is washed with ion exchange water until the pH value thereof is 6 to 8.

14. The latent electrostatic image bearing member according to claim 11, wherein the indefinitely shaped or low-crystallinity titanylphthalocyanine crystal is prepared by acid paste method and is washed with ion exchange water until the specific conductivity thereof is 8 μS/cm or less.

15. The latent electrostatic image bearing member according to claim 11, wherein the amount of the organic solvent used in the crystal conversion treatment of the titanylphthalocyanine crystal is 30 times or more, by mass ratio, the content of the indefinitely shaped or low-crystallinity titanylphthalocyanine crystal.

16. A method for producing a latent electrostatic image bearing member according to claim 1 comprising:

forming the charge transporting layer on the charge generating layer by applying a coating solution for charge transporting layer containing at least the charge transporting material, the binder resin, and a non-halogenated solvent, and drying the surface of the charge generating layer with the coating solution applied thereon, and subjecting the formed charge transporting layer to at least one surface treatment selected from heat treatment under a temperature environment of 80° C. to 150° C. for 1 hour to 50 hours, UV irradiation treatment, electron beam irradiation treatment, and corona discharge treatment.

17. An image forming method comprising:

forming a latent electrostatic image on the surface of a latent electrostatic image bearing member, developing the latent electrostatic image using a toner to form a visible image, transferring the visible image onto a recording medium, and cleaning a residual toner remaining on the surface of the latent electrostatic image bearing member, wherein the latent electrostatic image bearing member comprises a support, a charge generating layer, and a charge transporting layer, the charge generating layer and the charge transporting layer being arranged in this order on or above the support; the charge transporting layer comprises at least a charge transporting material and a binder resin and has a thickness of 30 μm to 50 μm; and the distribution representing the relation between the absorbance ratio of the charge transporting material and the binder resin measured by infrared spectroscopy and the distance from the surface of the charge transporting layer toward the thickness direction thereof represents a generally linear shape without having inflection points within 20 μm from the surface of the charge transporting layer toward the thickness thereof.

18. An image forming apparatus comprising:

a latent electrostatic image bearing member, a latent electrostatic image forming unit configured to form a latent electrostatic image on the surface of the latent electrostatic image bearing member, a developing unit configured to develop the latent electrostatic image using a toner to form a visible image, a transferring unit configured to transfer the visible image onto a recording medium, and a cleaning unit configured to remove a residual toner remaining on the surface of the latent electrostatic image bearing member, wherein the latent electrostatic image bearing member comprises a support, a charge generating layer, and a charge transporting layer, the charge generating layer and the charge transporting layer being arranged in this order on or above the support; the charge transporting layer comprises at least a charge transporting material and a binder resin and has a thickness of 30 μm to 50 μm; and the distribution representing the relation between the absorbance ratio of the charge transporting material and the binder resin measured by infrared spectroscopy and the distance from the surface of the charge transporting layer toward the thickness direction thereof represents a generally linear shape without having inflection points within 20 μm from the surface of the charge transporting layer toward the thickness thereof

19. The image forming apparatus according to claim 18, wherein the cleaning unit comprises at least a brush rotator, and the brush rotator rotates in the same direction of the rotational direction of the latent electrostatic image bearing member at a contact point with the latent electrostatic image bearing member.

20. The image forming apparatus according to claim 18, being a tandem image forming apparatus in which a plurality of image forming elements each comprising at least a latent electrostatic image bearing member, a charging unit, a developing unit, a transferring unit, and a cleaning unit are arrayed.

21. A process cartridge capable of being detachably mounted to a body of an image forming apparatus, comprising:

a latent electrostatic image bearing member, and at least one of units selected from a charging unit, a developing unit, a transferring unit, a cleaning unit, and a charge eliminating unit, wherein the latent electrostatic image bearing member comprises a support, a charge generating layer, and a charge transporting layer, the charge generating layer and the charge transporting layer being arranged in this order on or above the support; the charge transporting layer comprises at least a charge transporting material and a binder resin and has a thickness of 30 μm to 50 μm; and the distribution representing the relation between the absorbance ratio of the charge transporting material and the binder resin measured by infrared spectroscopy and the distance from the surface of the charge transporting layer toward the thickness direction thereof represents a generally linear shape without having inflection points within 20 m from the surface of the charge transporting layer toward the thickness thereof.

* * * * *